US009682349B2

(12) United States Patent
Broderick

(10) Patent No.: US 9,682,349 B2
(45) Date of Patent: Jun. 20, 2017

(54) POST/PEDESTAL-MOUNTED IBC MIXING/BLENDING MACHINE

(71) Applicant: Clifford Broderick, Rock Tavern, NY (US)

(72) Inventor: Clifford Broderick, Rock Tavern, NY (US)

( * ) Notice: Subject to any disclaimer, the term of this patent is extended or adjusted under 35 U.S.C. 154(b) by 923 days.

(21) Appl. No.: 13/910,277

(22) Filed: Jun. 5, 2013

(65) Prior Publication Data

US 2013/0329518 A1 Dec. 12, 2013

Related U.S. Application Data

(60) Provisional application No. 61/656,584, filed on Jun. 7, 2012.

(51) Int. Cl.
*B01F 9/08* (2006.01)
*B01F 7/00* (2006.01)
*B01F 15/00* (2006.01)

(52) U.S. Cl.
CPC ..... *B01F 7/001* (2013.01); *B01F 9/08* (2013.01); *B01F 15/00746* (2013.01)

(58) Field of Classification Search
CPC ..... B01F 9/08
USPC ..... 366/213, 220, 232
See application file for complete search history.

(56) References Cited

U.S. PATENT DOCUMENTS 5,246,290 A 9/1993 Bolz
5,649,765 A 7/1997 Stokes
7,160,023 B2 1/2007 Freude

*Primary Examiner* — David Sorkin
(74) *Attorney, Agent, or Firm* — Thomas A. O'Rourke; Bodner & O'Rourke, LLP

(57) ABSTRACT

A blending machine, for homogenizing materials deposited within an intermediate bulk container (IBC), includes: a frame; a drive motor; a clamp disk rotatably supported by the frame and coupled to the drive motor to drive disk rotation; first and second jaw clamps movably mounted to the frame; and a drive mechanism to drive the jaw clamps to translate toward each other and rotatably secure the IBC's boom to the rotatable clamp disk. A clutch, a torque limiter, and a limit switch limit the pressure applied by the clamps, and the extent of their travel to optimize clamping and rotatability. The blending machine is moveably mounted to a pedestal, and elevated by an actuator. A blending bar within the IBC is coupled through the boom to the clamp disk, and driven to rotate to blend the materials, in addition to mixing by rotation of the ICB.

19 Claims, 50 Drawing Sheets

(Prior Art Lid Arrangement)

(Prior Art Vent)

FIG. 16B
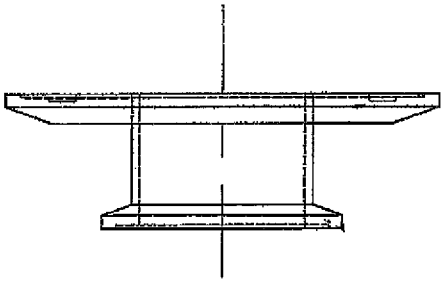
FIG. 16A
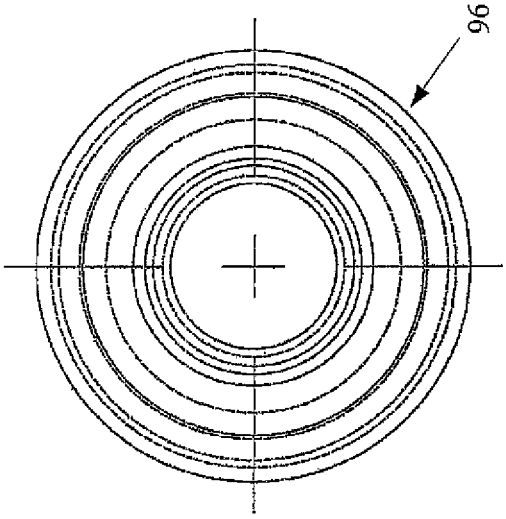
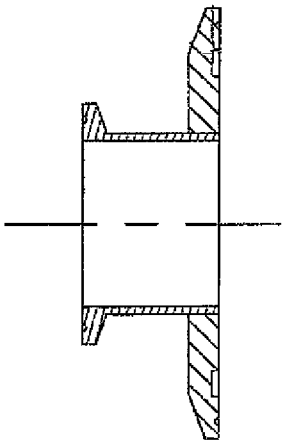
FIG. 16C

POST/PEDESTAL-MOUNTED IBC MIXING/BLENDING MACHINE

CROSS REFERENCES TO RELATED APPLICATIONS

This application claims priority on U.S. Provisional Application Ser. No. 61/656,584 filed on Jun. 17, 2012, the disclosures of which are incorporated herein by reference.

FIELD OF THE INVENTION

The present invention relates to improvements in apparatus and methods for industrial mixing/blending of components within an intermediate bulk container (IBC), and also to apparatus which are capable of reducing loss and waste of ingredients trapped in such pharmaceutical material handling and blending equipment.

BACKGROUND OF THE INVENTION

There are a wide range of consumer and industrial products whose manufacture requires one or more steps, where the mixing of large batches of constituent materials or ingredients must occur. Various improvements in this technical area are shown, for example, by U.S. Pat. No. 5,246,290 to Bolz for "Cone Mixer With Swivel Arm Drive and Sealing Arrangement Lubricated By An External Lubricant Receptacle," by U.S. Pat. No. 5,649,765 to Stokes for "Conical Mixer Apparatus with Contamination-Preventing Orbit Arm Assembly," and by U.S. Pat. No. 7,160,023 to Freude for "System for Detachably Coupling a Drive to a Mixer Mounted in a Portable Tank."

A critical aspect of such mixing of the component parts of a composition of matter, particularly for pharmaceutical products, is that the proportions be within set tolerances, and preferably be as close to an ideal mixture of such ingredients as possible. One difficulty encountered in any type of mixer is that in attempting to aggregate those constituent ingredients from individual containers, there are losses. The losses may occur by the trapping of perceptible amounts of each ingredient within respective containers, especially during the mixing and pouring process. Also, the amount of loss that occurs may vary for each material, depending on, for example, the ingredient's viscosity, the ambient temperature, and other conditions, making pre-determined adjustments to maintain the mixture's integrity not completely/repeatably accurate.

The invention disclosed herein reduces the losses resulting from the mixing of components in the manufacture of commercial batches of a product, and better serves to attain a reproducible and consistently accurate blend of ingredients.

In addition, the current invention also offers improvements in the form of a combination blending machine and lifting device that may accommodate both the transportation and the mixing of components within large sized bins typical for the manufacturing of pharmaceutical and other commercial products.

OBJECTS OF THE INVENTION

It is an object of the invention to provide an improved machine for accomplishing blending of constituent ingredients for the manufacturing of pharmaceutical and other commercial products.

It is another object of the invention to reduce or alleviate waste in commercial mixing of the ingredients of a product.

It is an object of the invention to improve the consistency and accuracy of the relative proportions of the constituent components within a commercial mixture.

It is another object of the invention to provide a commercial sized blending bin capable of being releasably received by a machine that provides for bin elevation and blending of the components within the bin.

It is a further object of the invention to provide a means of lifting blending bins upward and away from a transportation cart, to providing clearance necessary to conduct a blending operation using those bins.

It is another object of the invention to provide improved structure for supporting elevated bulk containers during rotational blending operations.

It is also an object of the invention to provide an improved manway cover clamping means for the blending bins, and an improved bin vent.

Further objects and advantages of the invention will become apparent from the following description and claims, and from the accompanying drawings.

SUMMARY OF THE INVENTION

The present invention comprises a post-mounted or pedestal-mounted mixing/blending machine that may be particularly adapted to releasably receive an intermediate bulk container (IBC), through a clamping arrangement, and thereafter rotate the IBC to cause mixing of various bulk materials deposited therein, such as powders, or granulate substances, or liquids for the making of chemicals, food, cosmetics, pharmaceuticals, etc. The mixing may be achieved by elevating the clamped IBC to be clear of a cart used for transporting the IBC, if the cart is not integral with the IBC, and then by rotating the IBC. Where desired or necessary, a specially constructed high-speed blending bar may be releasably disposed within the IBC to therein rotate at a higher rate than for the rotation of the IBC itself, and cause intensified blending of the ingredients therein. A specially constructed blending bar may permit the introduction of liquids directly into the IBC during the blending operation.

BRIEF DESCRIPTION OF THE DRAWINGS

FIG. 28 is the perspective view of FIG. 2A, but enlarged to show the boom of the V-shaped IBC prior to clamping by the jaw clamps and mechanism of the mixing/blending machine.

FIG. 16A is a top view of the cap of the vent assembly of FIG. 13A.

FIG. 16B is a side view of the cap of FIG. 16A.

FIG. 16C is a cross-sectional view through the cap of FIG. 16A.

DETAILED DESCRIPTION OF THE INVENTION

Figure 1:
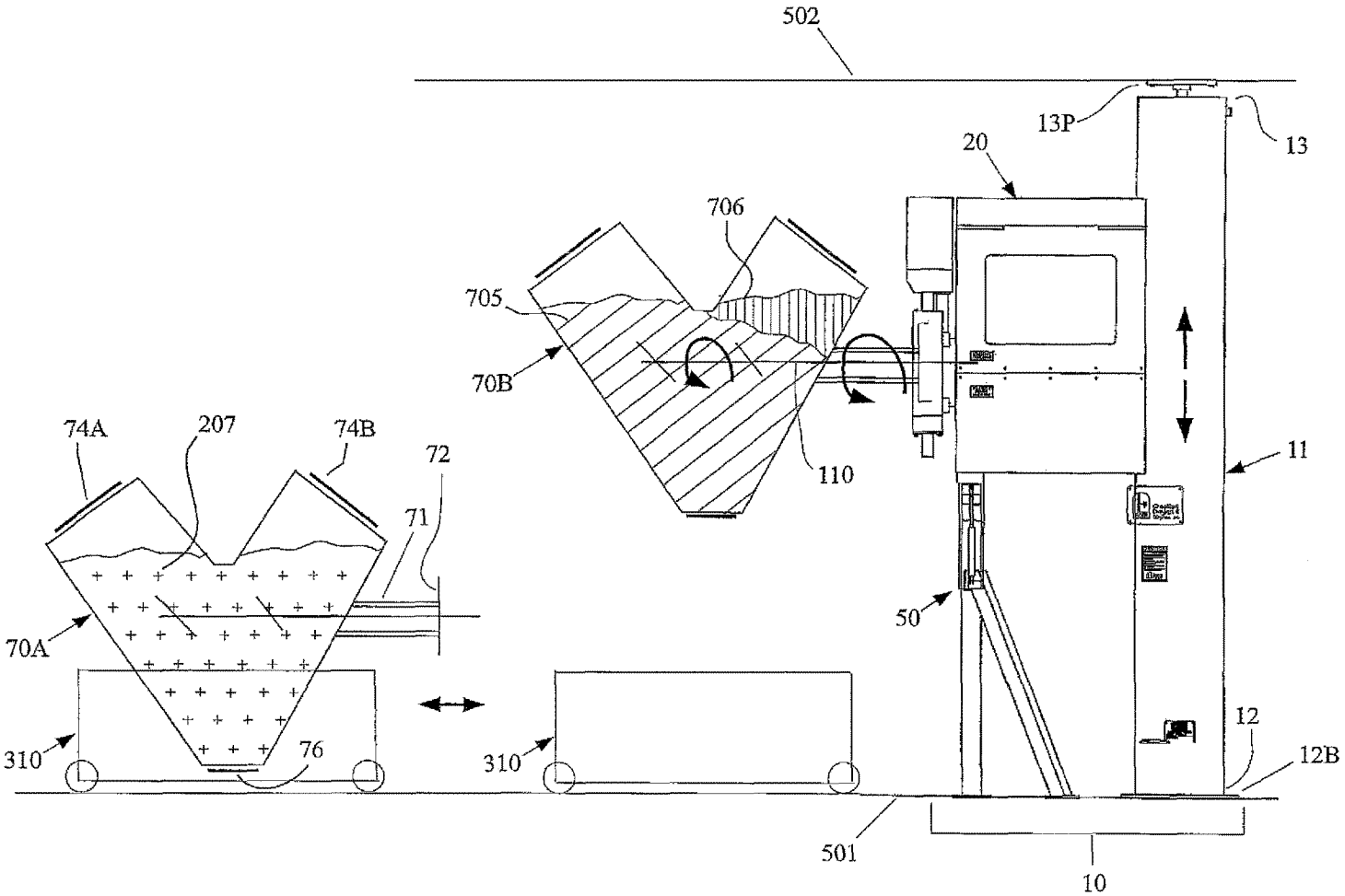
FIG. 1 is a side view illustrating a transportation and subsequent mixing operation of an intermediate bulk container (IBC), using a post-mounted mixing/blending machine of the present invention

FIG. 1 is a side view illustrating the overall process of a transporting an intermediate bulk container 70 ("IBC"—i.e., generally having a volume ranging between that of 500 liter drums and 3000 liter tanks), which may be set upon, or integral with, a multi-wheeled cart 210. The IBC shown therein may be transported toward/away from a post-mounted mixing/blending machine 10 of the present invention. The post-mounted mixing/blending machine 10 may be particularly adapted to releasably receive the IBC, through a clamping arrangement, and thereafter manipulate the IBC 70 (e.g., rotate the IBC) to accomplish the mixing of bulk materials therein, such as powders or granulate substances, and may also accomplish the blending of liquids therewith, for the making of chemicals, food, cosmetics, pharmaceuticals, etc. The mixing/blending may be achieved by elevating the IBC 70 to be clear of the cart 210, if the cart is not integral with the IBC, by rotating the IBC, and, where desired, by also driving a specially constructed high-speed blending bar 110 that may be releasably disposed within the IBC. A further understanding of the new and unique aspects of the present invention may be obtained from a detailed discussion of each of the components, which are illustrated throughout the Figures.

Figure 1A:
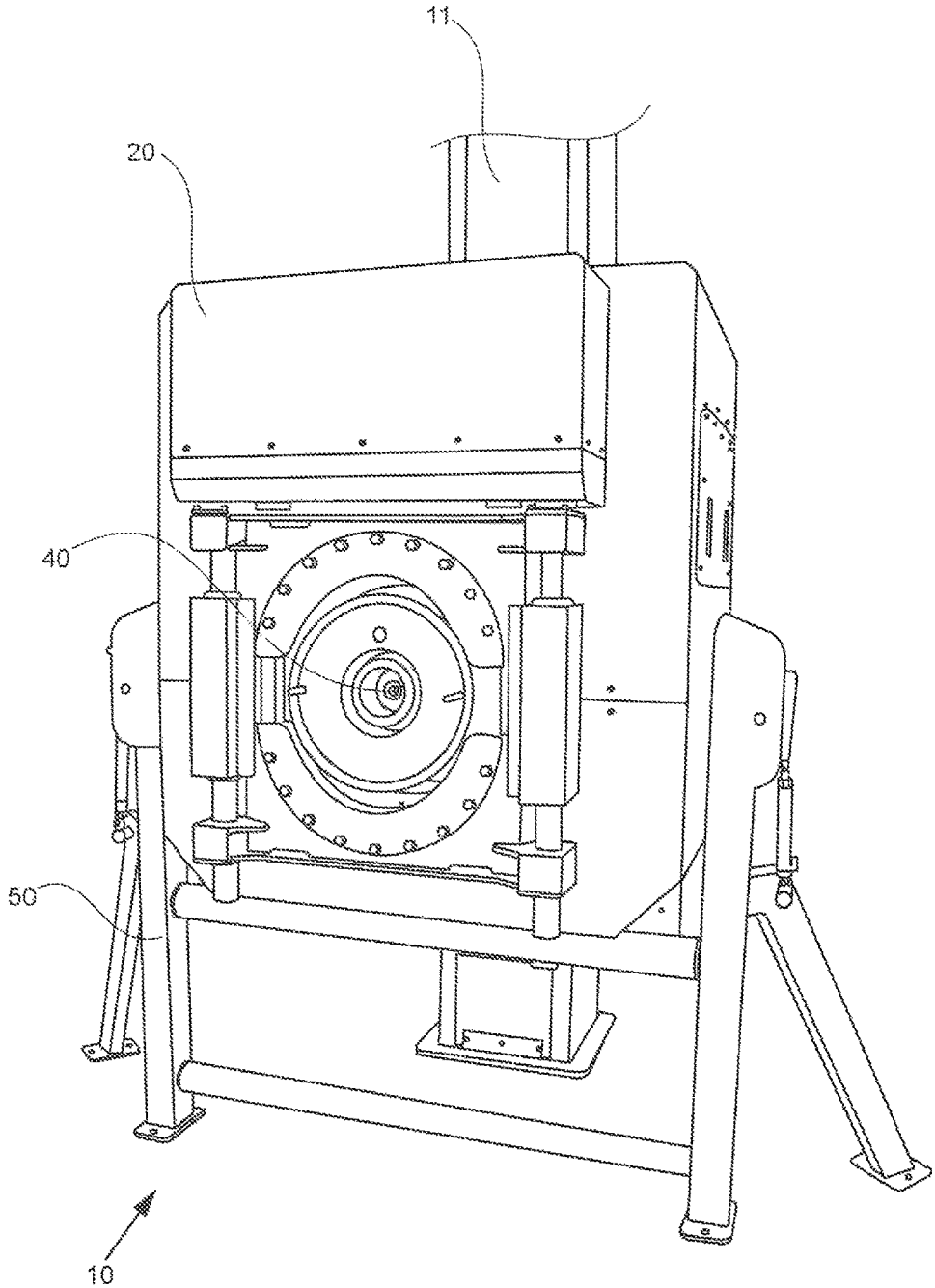
FIG. 1A is a front perspective view of the post-mounted mixing/blending machine of FIG. 1.
Figure 1B:
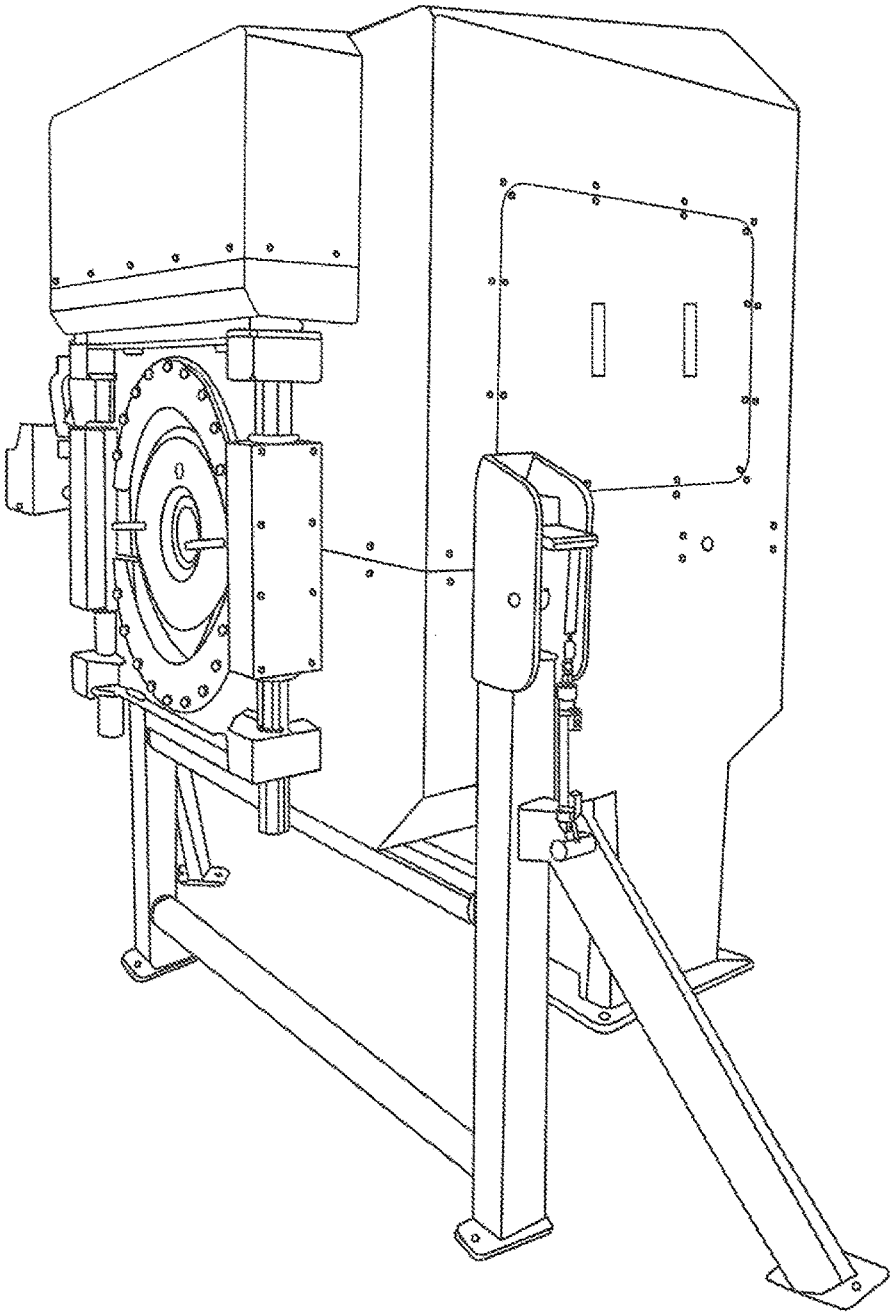
FIG. 1B is a side perspective view of the post-mounted mixing/blending machine of FIG. 1.
Figure 1C:
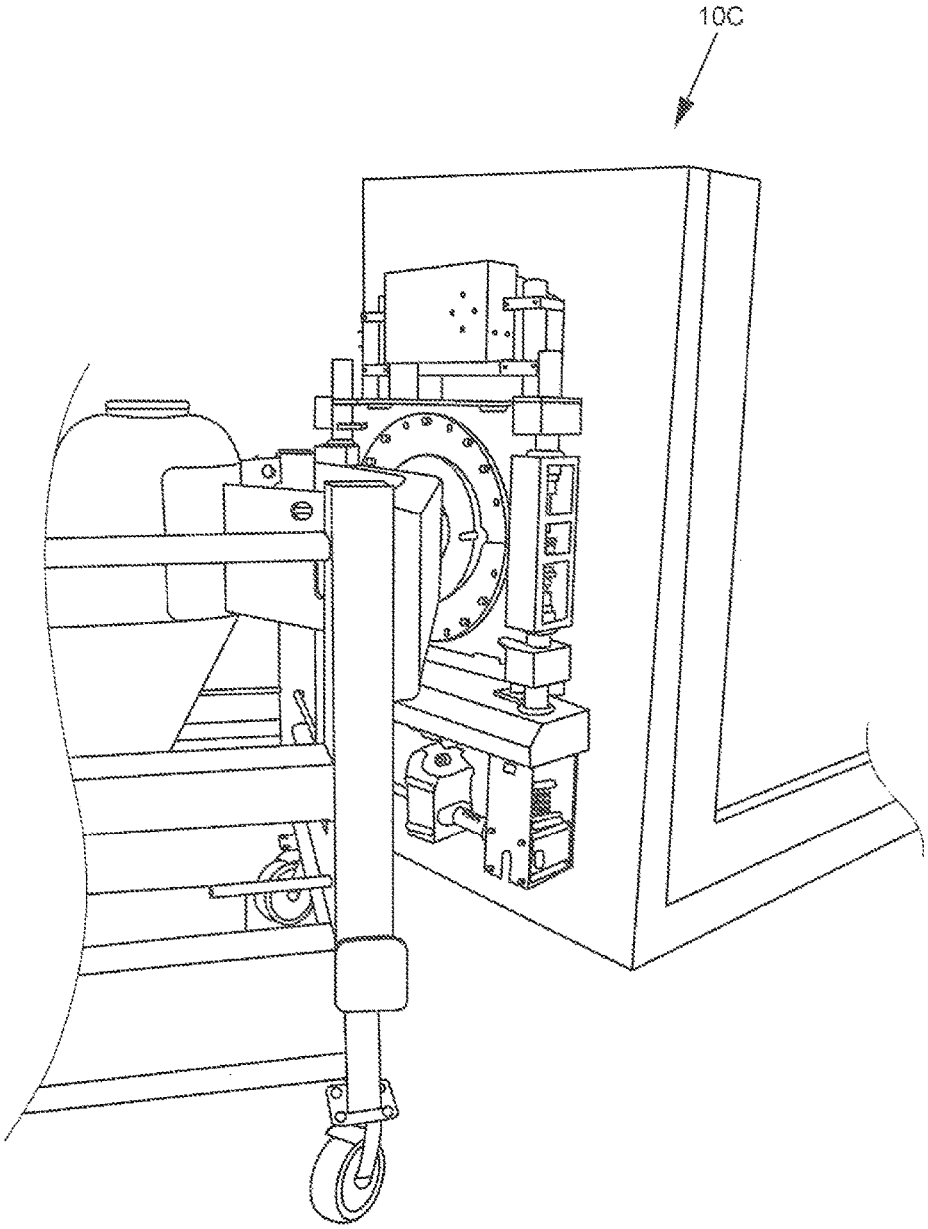
FIG. 1C is a side perspective view of a pedestal-mounted mixing/blending machine of the current invention, with a boom of a dolly-mounted intermediate bulk container being secured within the clamping mechanism of the blender machine.
Figure 1D:
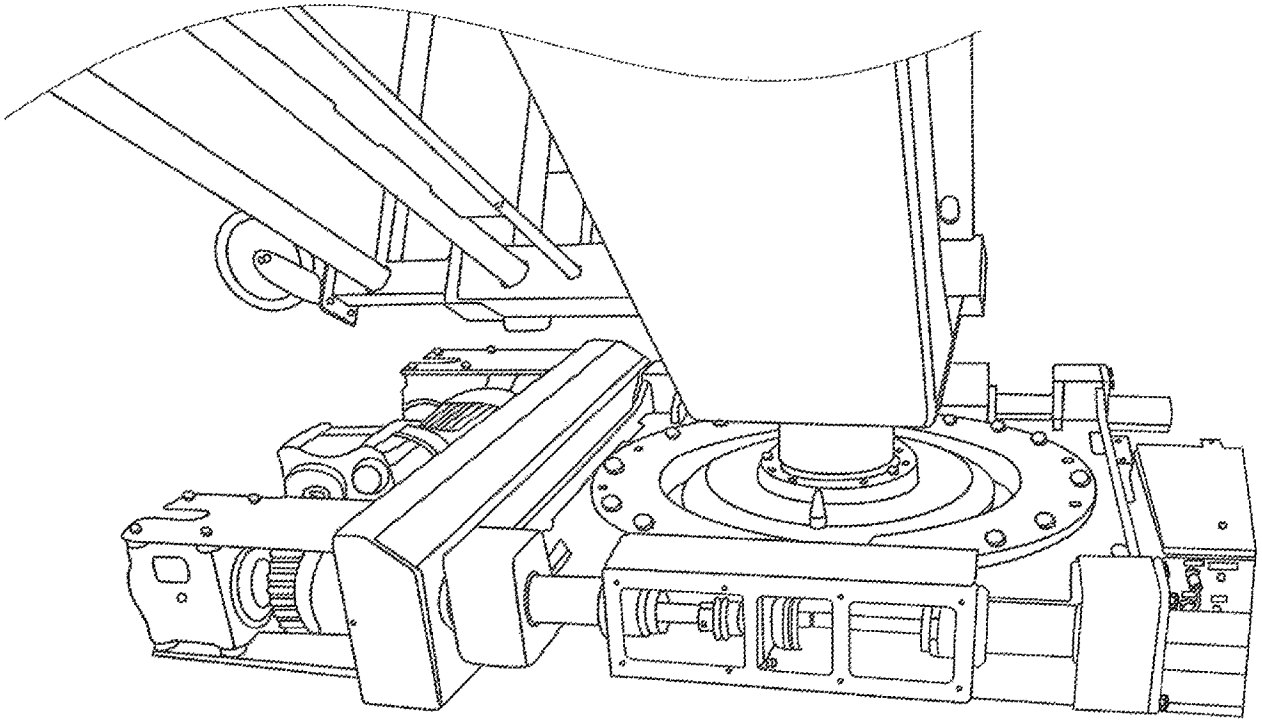
FIG. 1D is the perspective view of the pedestal-mounted mixing/blending machine of FIG. 1C, but enlarged to show the IBC boom being received within the blender clamping mechanism.
Figure 1E:
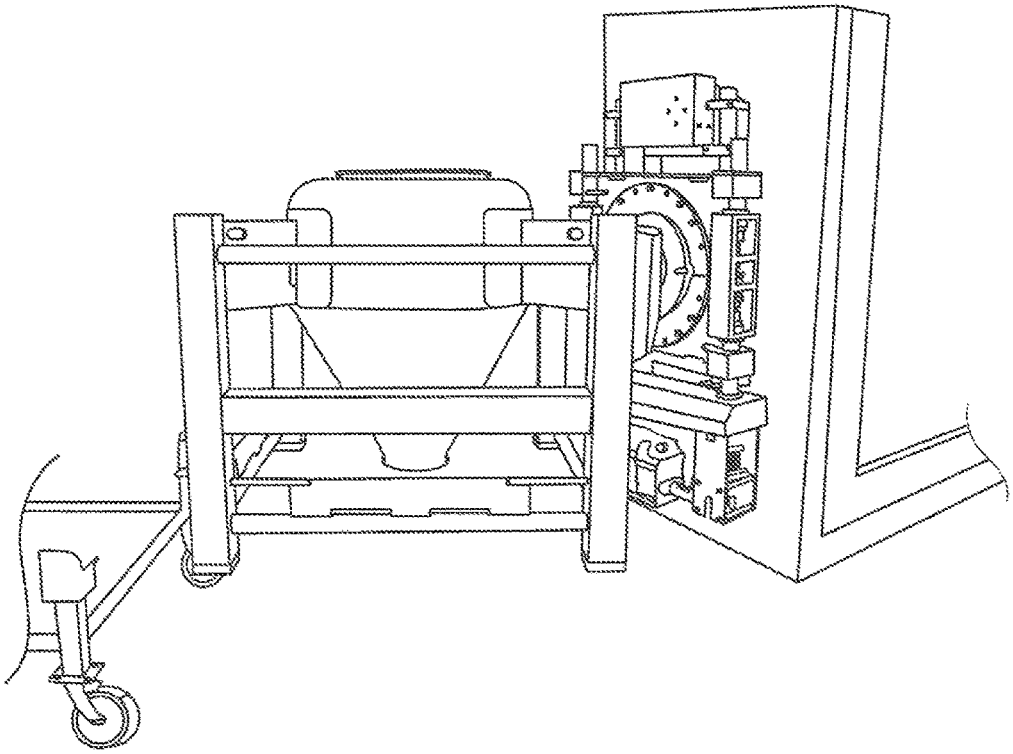
FIG. 1E is the pedestal-mounted mixing/blending machine of FIG. 1D, with the actuator having lifted the IBC and integral frame upward, and with the IBC dolly having been moved away from the IBC.
Figure 1F:
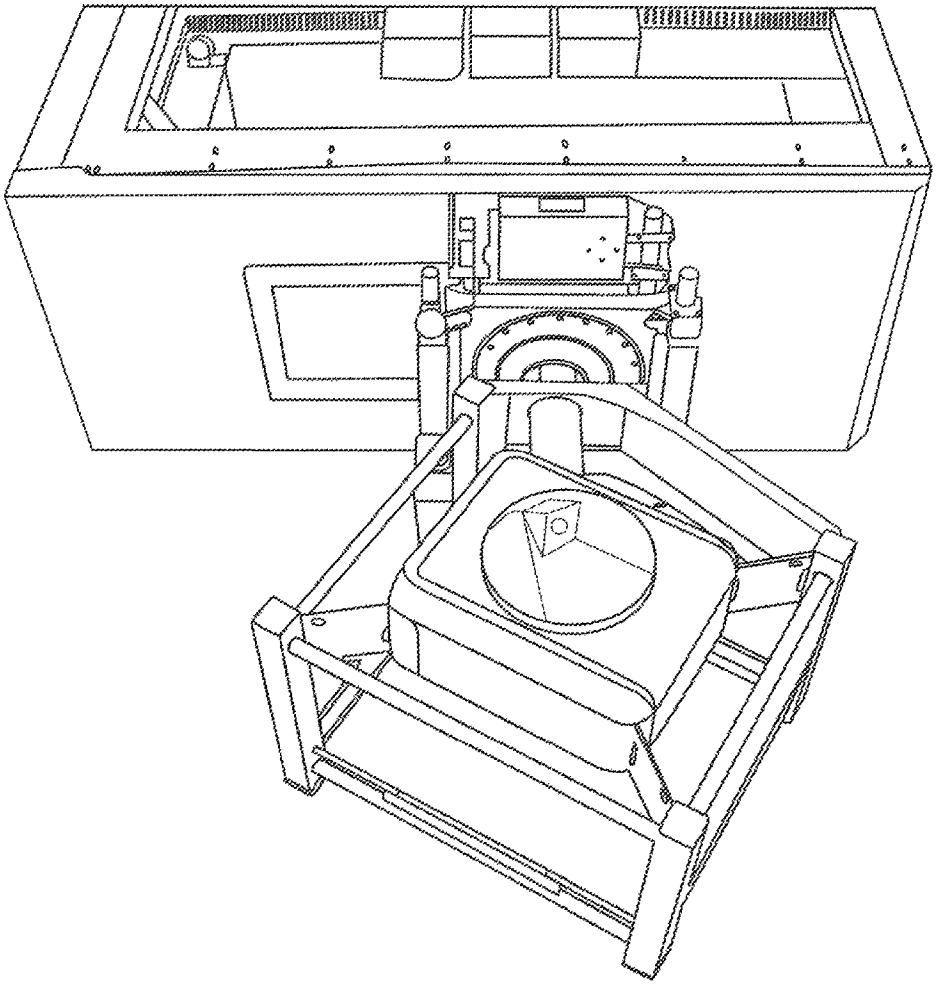
FIG. 1F is the pedestal-mounted mixing/blending machine of FIG. 1E, with the machine causing rotation of the IBC, which would achieve mixing of bulk materials/ingredients therein.
Figure 2A:
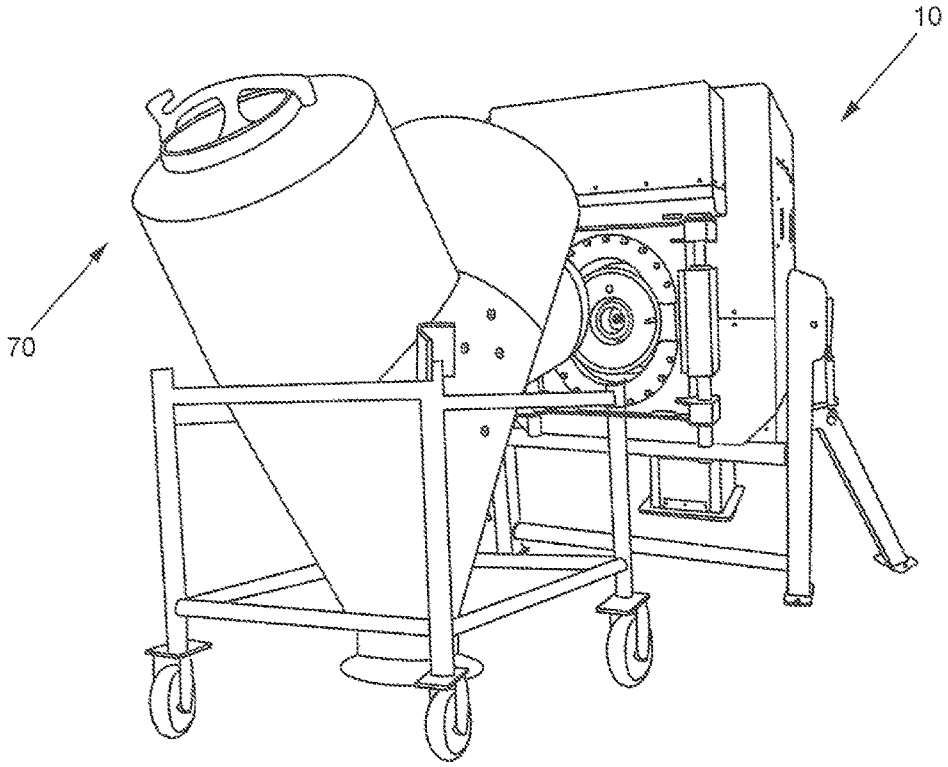
FIG. 2A is a perspective view showing a V-shaped IBC being cradled by a dolly, as the IBC is being advanced to have its boom be secured within the clamping mechanism of the post-mounted mixing/blending machine.
Figure 2B:
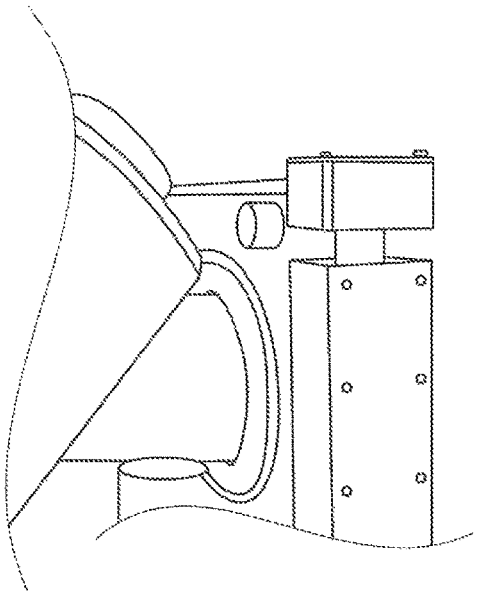
FIG. 2C is the perspective view of FIG. 2A, but enlarged to show the boom of the V-shaped IBC after clamping by the mechanism of the mixing/blending machine.
Figure 2C:
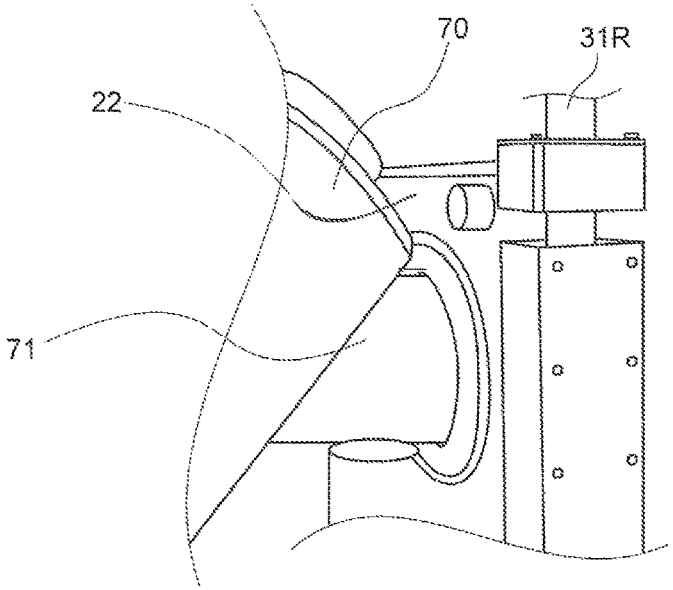
Figure 3:
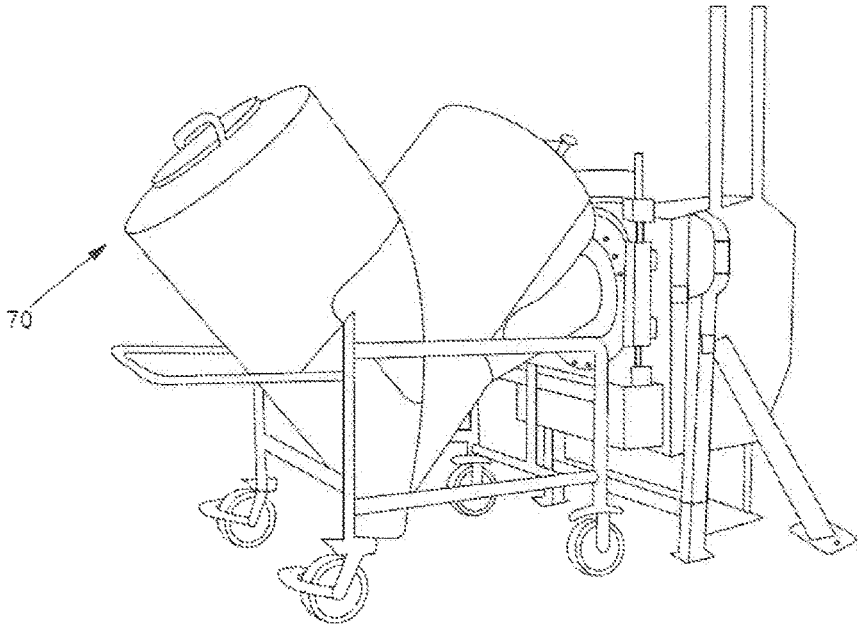
FIG. 3 is a perspective view of the V-shaped IBC being cradled by the dolly and secured to the post-mounted mixing/blending machine.

The post-mounted blending machine 10 of the present invention is shown in a perspective view within FIGS. 1A-1B, while a pedestal-mounted blending machine 10A of the present invention is shown within FIGS. 1C-1F. As seen in FIG. 1, the post-mounted blending machine 10 may include a post 11, a machine portion 20, and blend nest support structure 50. The post 11 may have a lower first end 12 and an upper second end 13. Lower end 12 may be fixedly connected to a base member 12B, which may be secured to the floor 201 of a manufacturing facility using bolts or another fastening means. Alternatively, the lower end 12 may have a pivotal connection to the base member 12B. The post 11 may have the second (upper) end 13 also be directly connected to an upper plate member 13P, which may be fixedly secured to the ceiling/roof structure 202 using bolts or another fastening means. Alternatively, the upper end 13 of post 11 may have a pivotal connection to the upper plate member 13P. In addition, rather than fastening the upper and lower portions of the post 11 to the ceiling and the floor, respectively, a tripod arrangement could instead could be used to support the post to allow it to be free-standing, and transportable throughout the interior of a manufacturing facility.

Figure 4:
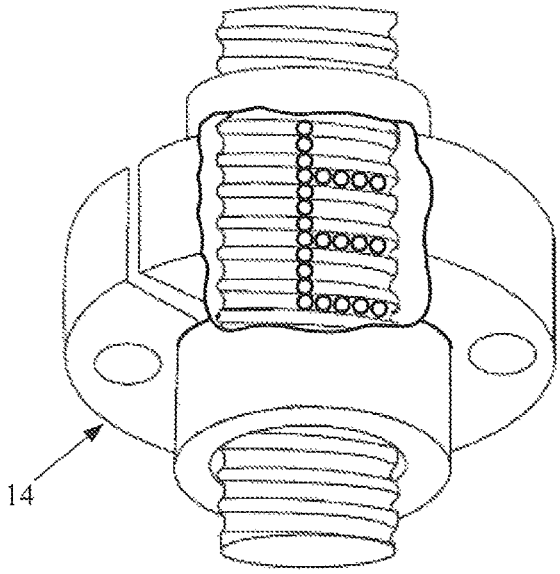
FIG. 4 is a perspective view of a ball-screw actuator that may be utilized to lift and lower the mixing/blending machine up and down the post, while having an IBC clamped thereto.
Figure 4A:
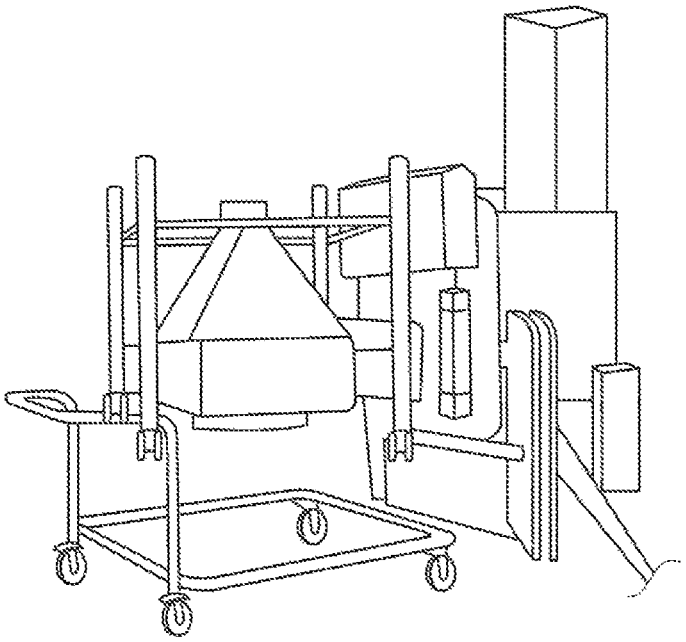
FIG. 4A shows a frame-mounted IBC that is clamped within the post-mounted mixing/blending machine, and is initially being lifted, by the actuator, off of its dolly.
Figure 4B:
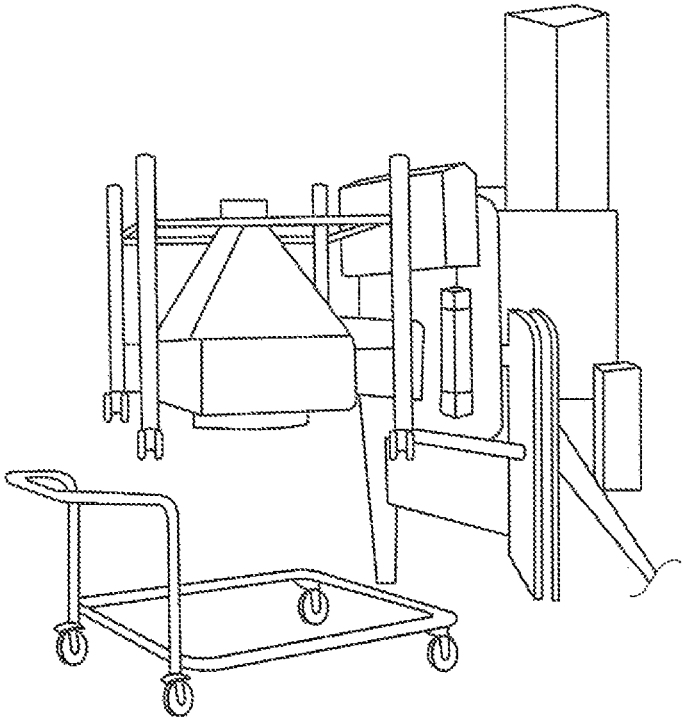
FIG. 4B shows the post-mounted mixing/blending machine of FIG. 4A, after being lifted above the height of the dolly to engage the blending nest support structure, to be ready for rotation for mixing of the ingredients within the IBC.
Figure 4C:
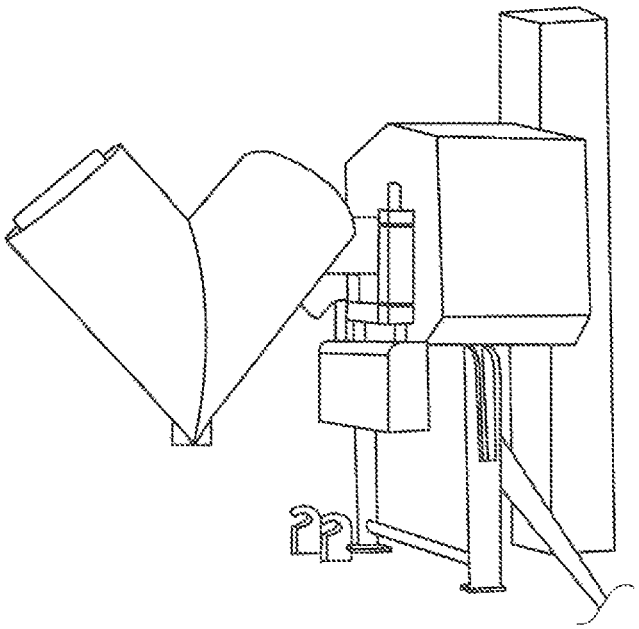
FIG. 4C shows a non-frame-mounted, V-shaped IBC clamped within the post-mounted mixing/blending machine of FIG. 4A, after the machine has been lifted to engage the blend nest support structure, to be ready for rotation for mixing of the materials within the IBC.
Figure 4D:
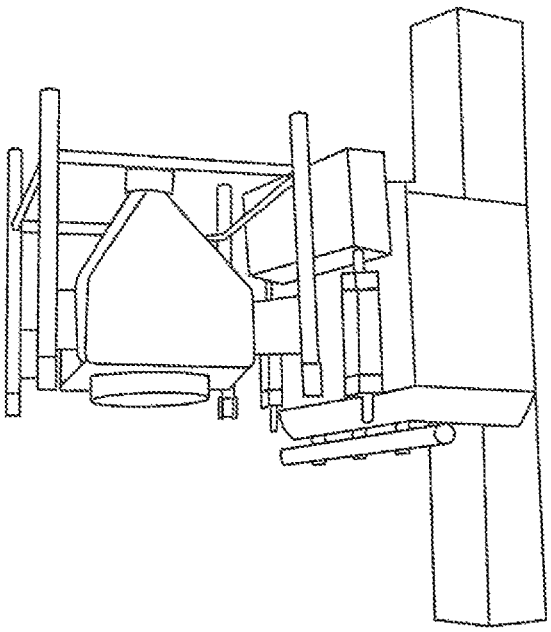
FIG. 4D shows the post-mounted mixing/blending machine of FIG. 4B, after being further lifted vertically to be disengaged from the blend nest support structure and to be ready for discharge of the ingredients from the IBC.

The post 11 may comprise a ball/screw actuator 14 therein (see FIG. 4) to be capable of vertically lifting and lowering the machine portion 20 to various different with respect to the floor. The primary positions include the load position (FIG. 5C), the blending position (FIG. 5D), and the discharge position (FIG. 5E). Post 11 may also comprise a rotary actuator to permit post rotation utilizing the aforementioned pivotal connections at the ends 12 and 13 of the post. The post 11 itself and the lifting components have all been designed to be cGMP compliant, meaning that their production and testing complies with current Good Manufacturing Practices that have been legislated for the safeguarding of the health of a patient, through the production of good quality pharmaceutical products and/or medical devices. The column may be a one-piece structural member preferably made of 304 stainless steel, and may have all of the mechanical components mounted internally to reduce dirt build-up locations that are both unsafe and damaging to the overall quality of the operation/facility. A positive seal closure allows the post to be completely sealed.

Figure 5A:
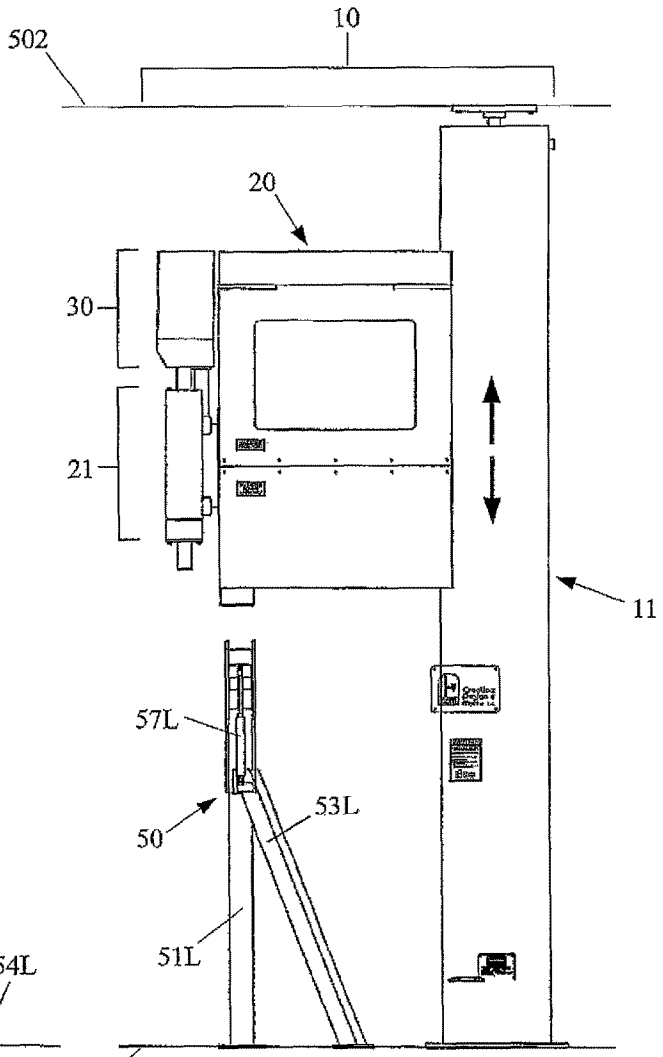
FIG. 5A is a side view of the post-mounted mixing/blending machine, just prior to engagement with the nest support arrangement.
Figure 7A:
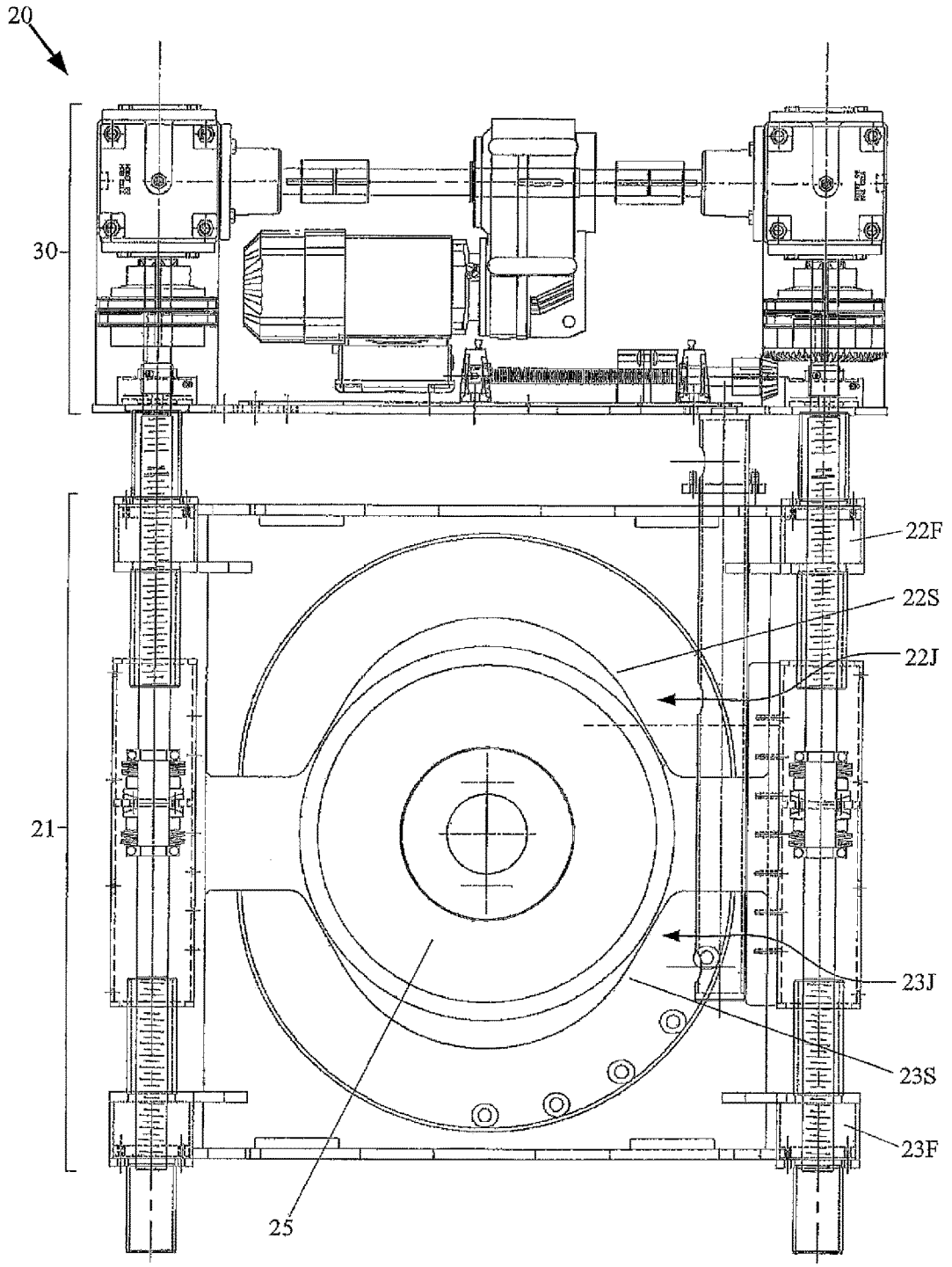
FIG. 7A is an enlarged front view of the post-mounted mixing/blending machine, with the upper and lower jaw clamps being distal from each other in the unclamped position.
Figure 7B:
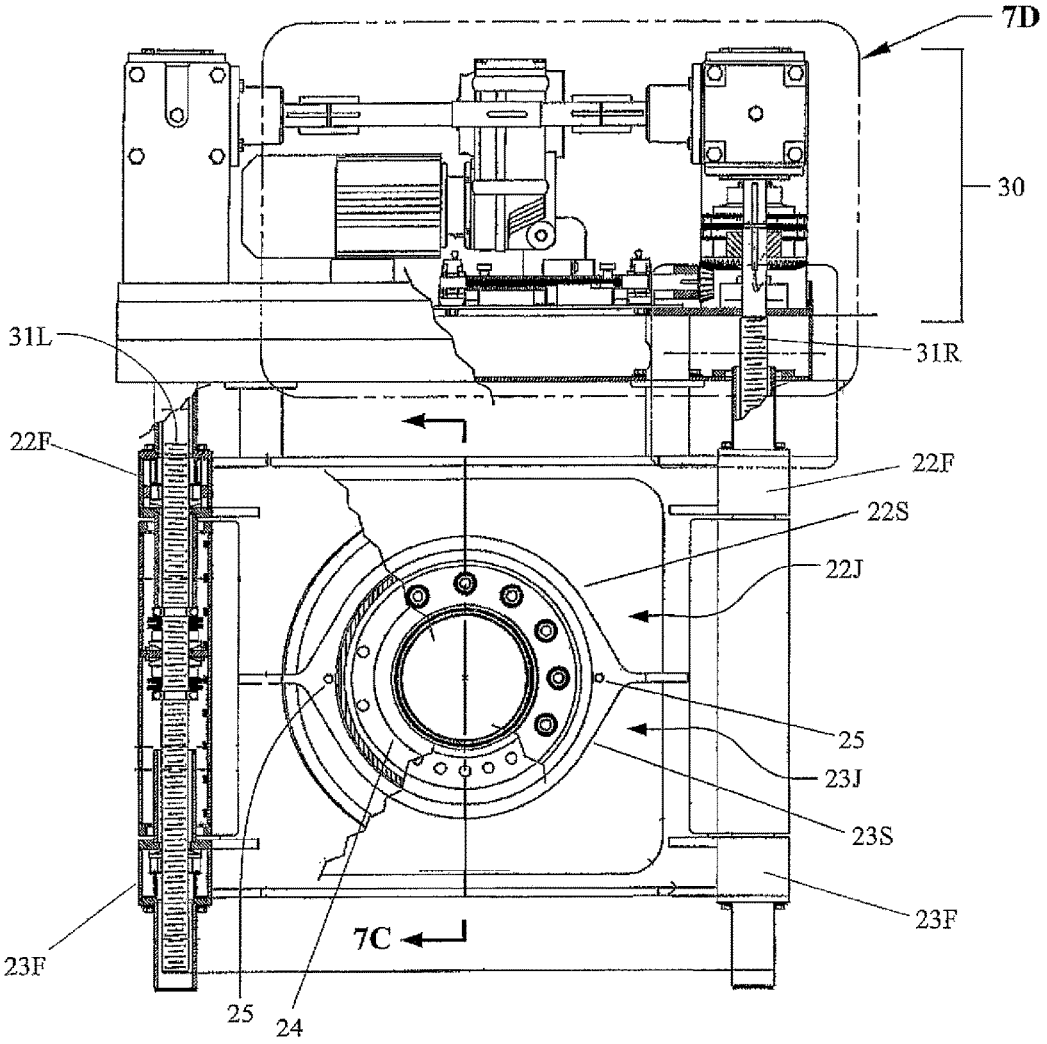
FIG. 7B is the post-mounted blender machine of FIG. 7A, after the upper and lower jaw clamps have translated towards each other to be in the clamped position.
Figure 7C:
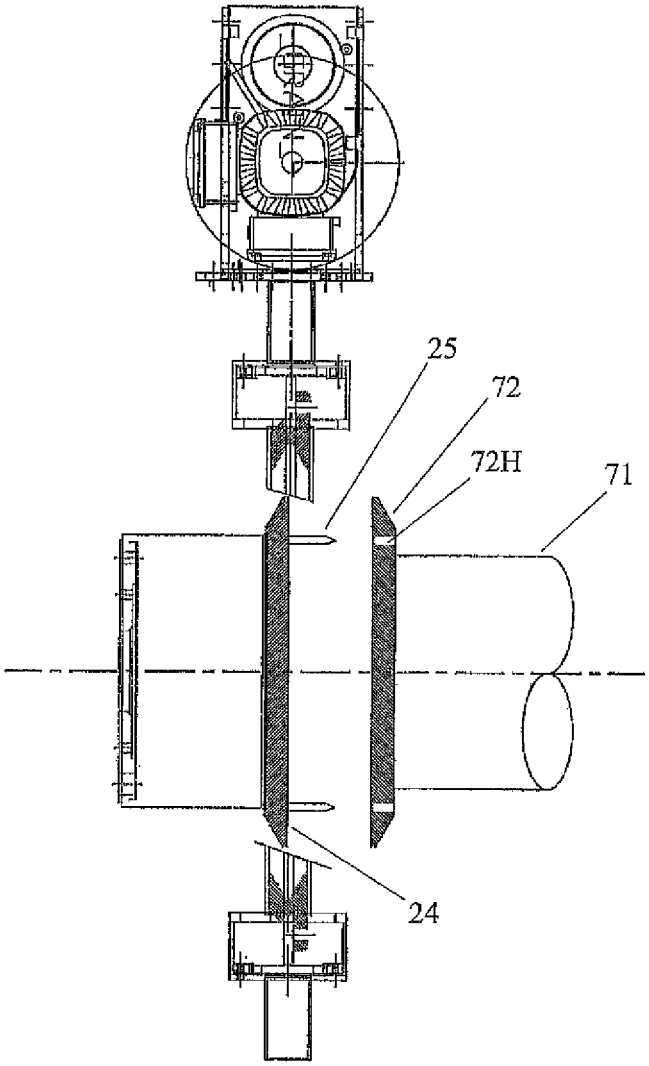
FIG. 7C is a cross-section through the upper and lower jaw clamps and the disk of the mixing/blending machine, as the disk of the IBC boom advances to be clamped by the machine.

As seen in the side view of FIG. 5A, the machine portion 20 may generally comprise clamping structure 21, and a clamp drive mechanism 30, which are shown in greater detail within FIGS. 7A and 7B, and which are interconnected. The machine portion 20 in FIG. 7A is shown with its jaw clamps, for clamping of an IBC boom therein, in the open (unclamped) position, and is shown in FIG. 7B with the jaw clamps having been translated into the closed (clamped) position. The clamping structure 21 may comprise an upper clamp jaw travel frame 22F having a semi-circular peripheral edge 22S with a large upwardly oriented arc, and a floating clamp jaw 22J. The clamping structure 21 may also comprise a lower clamp jaw travel frame 23F having a semi-circular peripheral edge 23S with a large downwardly oriented arc, and a floating clamp jaw 23J. Shapes other than semi-circular (e.g., rectangular) may be utilized, but may also be less advantageous. The lower clamp jaw travel frame 23F and floating clamp jaw 23J are illustrated within FIG. 7F. The lower clamp jaw travel frame 23F and floating clamp jaw 23J are shown just prior to assembly within the section view of FIG. 7G, and within the section view of FIG. 7H after being joined. Over-size holes (23H/22H) in the frames 22F/23F allow the respective jaws to float with respect to the travel frames.

The upper clamp jaw travel frame 22F and lower clamp jaw travel frame 23F may be disposed adjacent to a cylindrical clamp disk member 24 that may be coupled to a drive motor, and which may receive a flanged boom of an IBC 70 that is to be clamped within the machine.

Figure 7D:
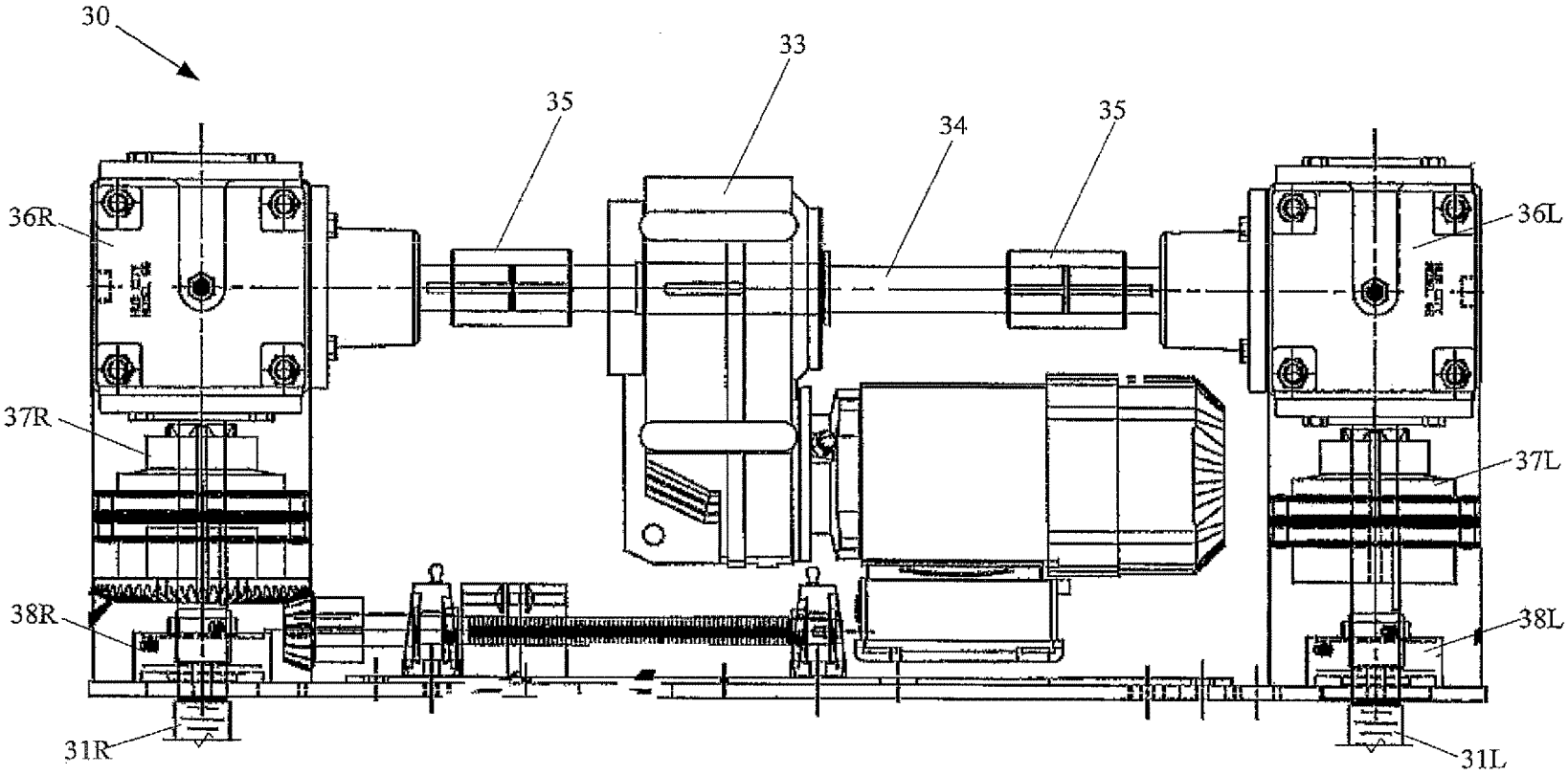
FIG. 7D is a detail view of the drive mechanism of the mixing/blending machine of FIG. 7A.
Figure 7E:
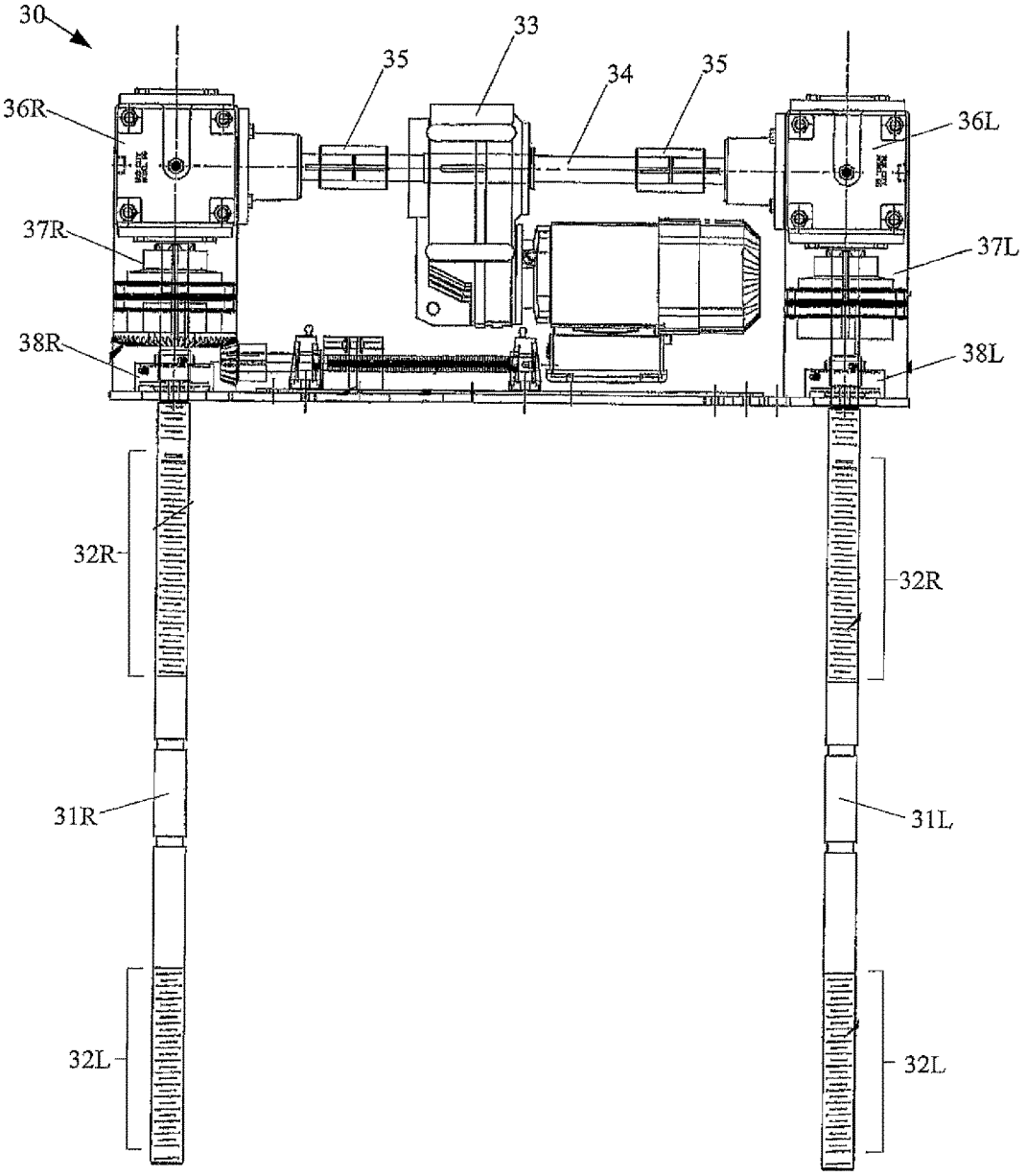
FIG. 7E is an enlarged detail view of the drive mechanism of FIG. 7D.
Figure 7F:
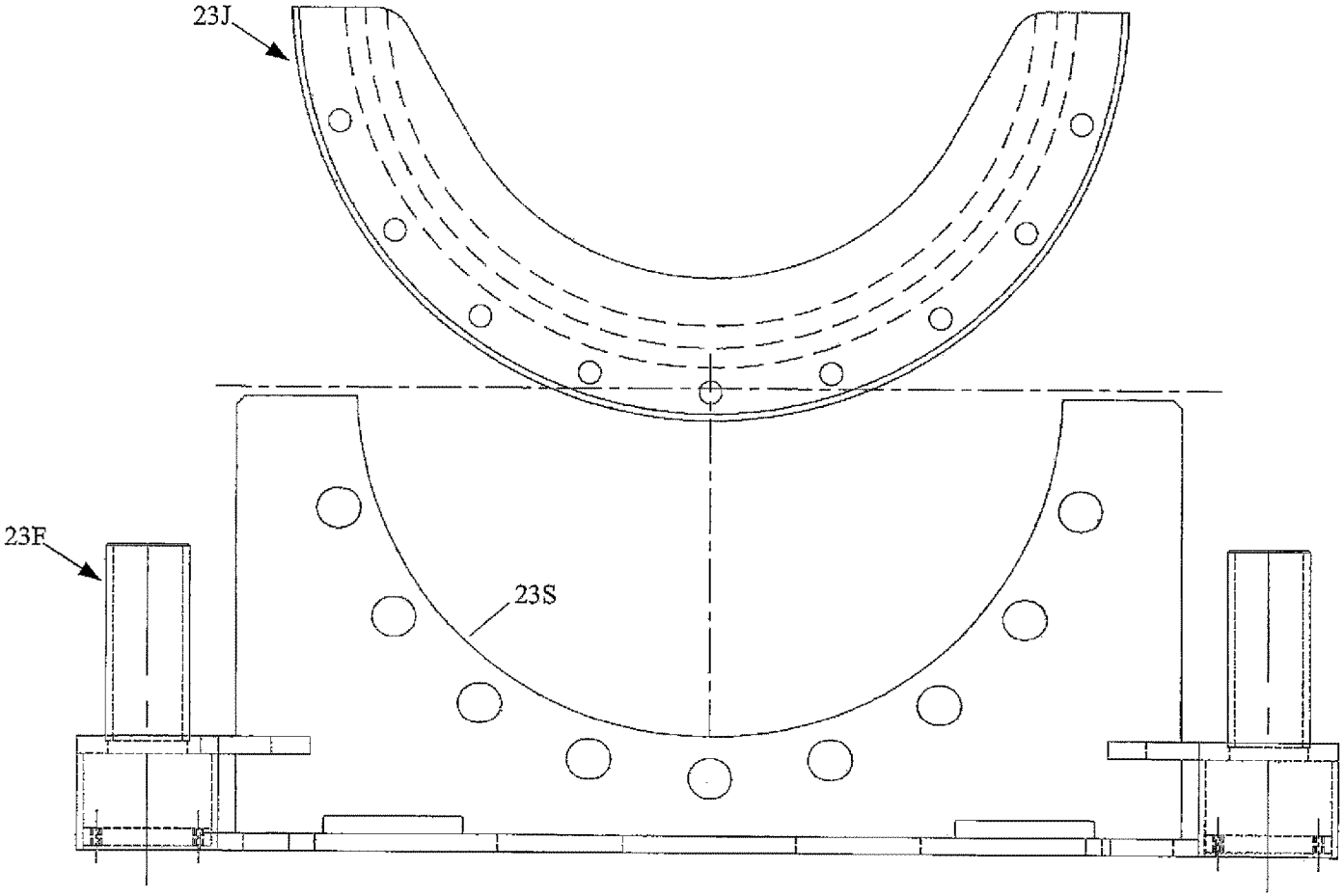
FIG. 7F is an enlarged front view showing the lower clamp jaw travel frame and the respective floating clamp jaw, prior to being joined.

The upper clamp jaw travel frame 22F and lower jaw frame 23F may each be threadably connected and supported by a pair of shafts 31L/31R that form a portion of the clamp drive mechanism 30, and which are illustrated, in part, within FIG. 7D, and also in FIG. 7E. The clamp drive mechanism 30 may comprise a drive motor 33 that may generate torque to a shaft 34 that, through a pair of coupling 35, may thereafter simultaneously transmit that torque to a right angle gear box 36L on the left side of machine 20, and to a right angle gear box 36R on the right side of the machine. The right angle gear box 36R on the right side may transmit that torque, through clutch 37L, and with the support of bearing 38L, to the left side shaft 31L, while the right angle gear box 36L on the left side may transmit that torque, through clutch 37R, and with the support of bearing 38R, to the right side shaft 31R. (Note that shaft 34 of the drive motor 33 may also be used to also drive the cylindrical clamp disk member 24, however, separate motors may alternatively be utilized).

As seen in FIG. 7E, the upper portion of both the left side shaft 31L and the right side shaft 31R may each comprise right-hand ACME screw threads 32R, while the lower portion of the left side and right side shafts 31L/31R may comprise left-hand ACME screw threads 32L. Thus, when the shafts 31L/31R in FIG. 7A are driven to rotate, the right-hand ACME screw threads of the upper left side and right side shafts 31L/31R will engage corresponding threading in the upper clamp jaw travel frame 22F, causing the upper clamp jaw travel frame 22F to be driven to translate downward, while the left-hand ACME screw threads of the lower left side and right side shafts 31L/31R will engage corresponding threading in the lower clamp jaw travel frame 23F, causing the lower jaw frame 23F to be driven to translate upward. Counter-rotation of the shafts 31L/31R would cause the clamp jaw travel frames to translate away from each other.

Figure 7G:
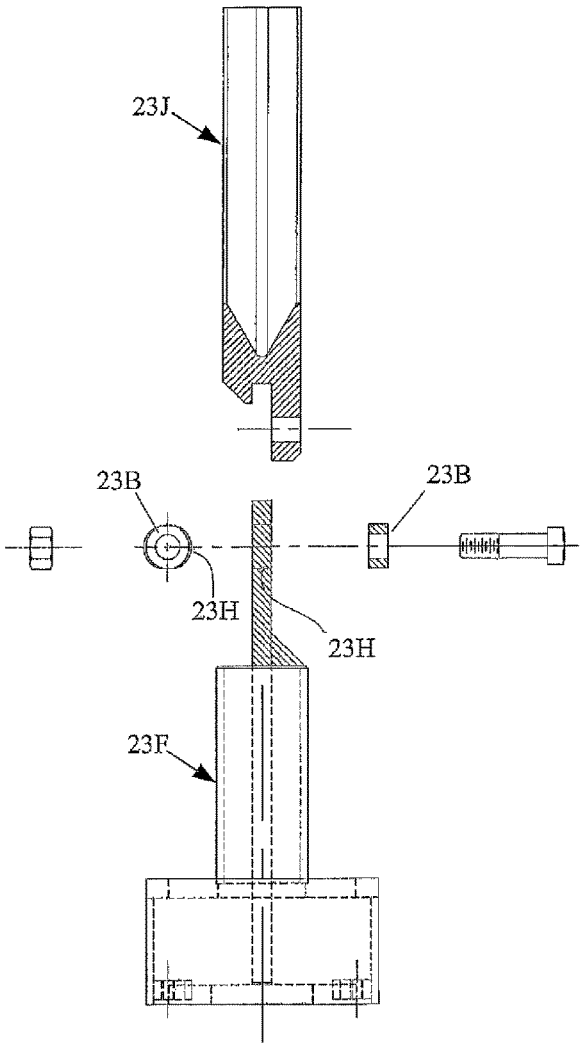
FIG. 7G is a cross-sectional view through the lower clamp jaw travel frame and the floating clamp jaw of FIG. 7F.
Figure 7H:
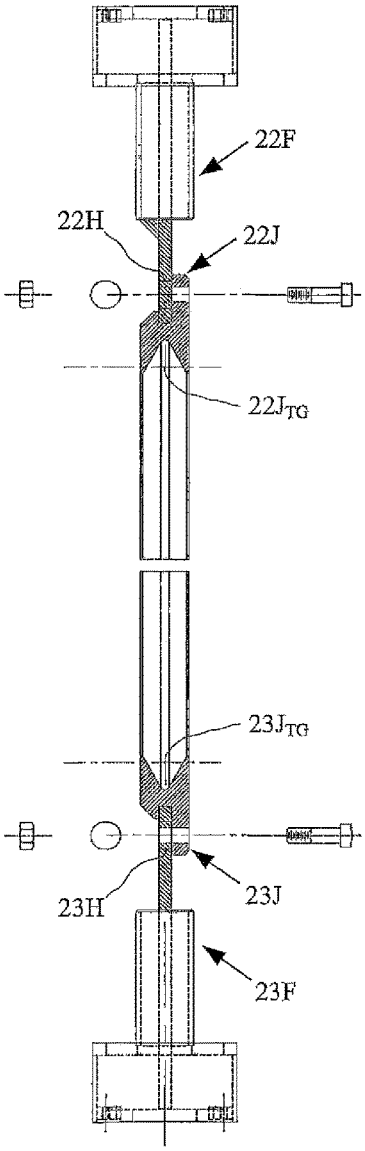
FIG. 7H is the cross-sectional view of FIG. 7G, after the clamp jaw had been joined with the lower clamp jaw travel frame, and also showing the upper clamp jaw joined with the upper clamp jaw travel frame.

The converging movements of the upper clamp jaw travel frame 22F and the lower clamp jaw travel frame 23F causes the disk 72 of boom 71 of IBC 70 (see FIGS. 1 and 7C) to be clamped with respect to the cylindrical clamp disk member 24. (Note that instead of using a pair of shafts for slidably supporting the upper clamp jaw frame 22F and the lower clamp jaw frame 23F, a single shaft may instead be utilized, which may be positioned to be in-line with the clamp disk member 24, however, the dual shaft arrangement may offer greater stability, and the single shaft arrangement would require repositioning behind the clamp disk, so as not to interfere with the IBC boom). The clamped disk 72 of the IBC boom may thereby be driven to rotate by the engagement of two or more prongs 25 on the disk member 24 being received within corresponding holes 7211 in the disk 72 of the IBC boom 71. An optimal amount of pressure may be applied at the tongue and groove area $\mathbf{22}J_{TG}/\mathbf{23}J_{TG}$ (FIG. 7H) of the floating clamp jaws 22J/23J of the upper and lower clamp jaw travel frames 22F/23F, by having the force applied by the ACME screws be limited through the clutch 37L/37R and a torque limiter. A limit switch may make contact at the point of engagement $\mathbf{22}J_{TG}/\mathbf{23}J_{TG}$ between the jaws and the discs 24 and 72, while a timer may allow the motor to continue to drive to ensure sufficient clamping pressure. Over-sized slotted holes (22H/23H) in the frames 22F/23F allow the respective jaws to float with respect to the travel frames, and to thereby seat around the mating clamp discs 24 and 72. As seen in FIG. 7G, a bushing 23B having a diameter of 1.120 inches may be retained within a slotted hole 23H in the frame 23F, which may have a width dimension of 1.250 inches.

Figure 8:
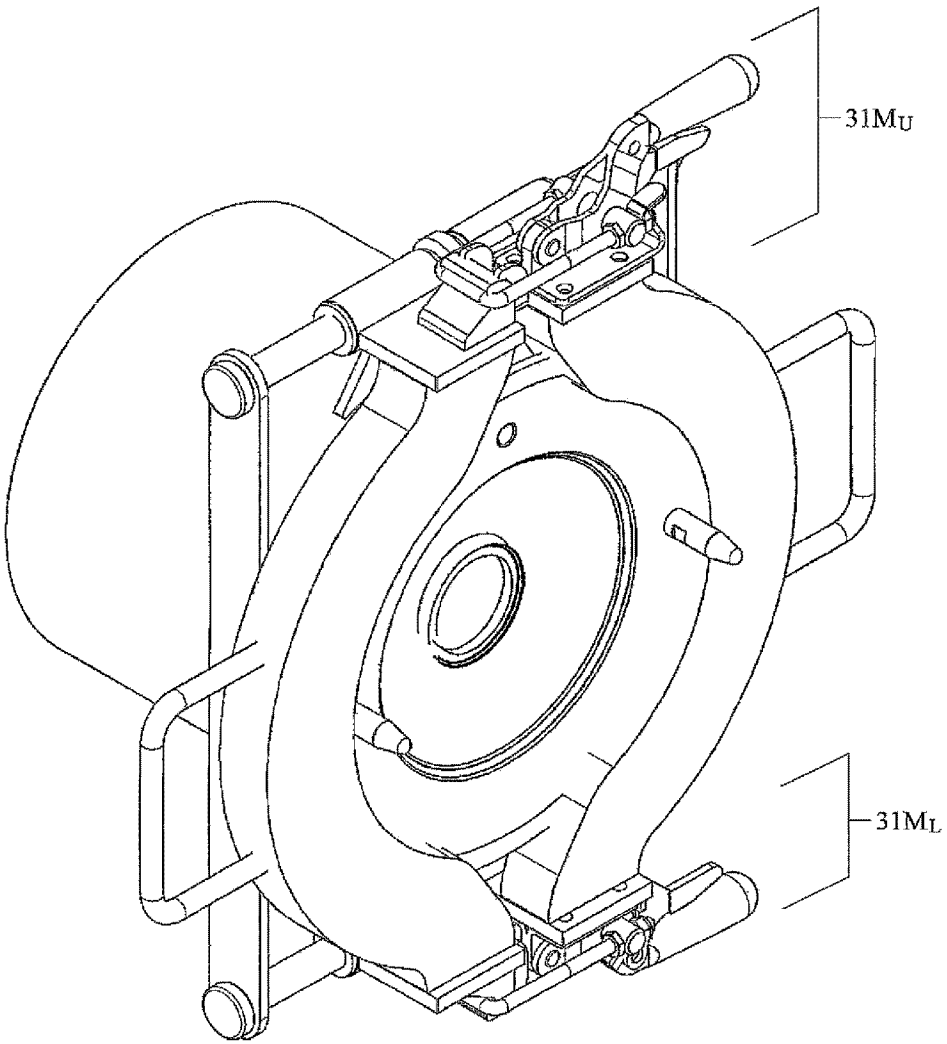
FIG. 8 is a perspective view of an alternate embodiment of a clamping mechanism usable with the mixing/blending machine of FIG. 7.

An alternative manual clamping arrangement is shown in FIG. 8, whereby upper and lower clamps $\mathbf{31}M_U$ and $\mathbf{31}M_L$ may serve to clamp-up two jaw plates, which may clamp-up by being driven together manually and in opposing horizontal directions.

Therefore, as seen in FIG. 1, a V-shaped IBC 70 may be supported by, or have a portion of it cradled within, a wheeled cart 210, for transportation of the IBC about the floor 201 of a manufacturing facility. Although a V-shaped bin is illustrated, various different bin shapes can be used by blending machine 10, including: square, round, rectangular, or a custom shape. The bin may preferably be made of stainless steel, so that it can be cleaned easily and be residue-free, because there is no diffusing of product into the stainless steel container wall. The stainless steel IBC can therefore be used for mixing/blending, with frequent changes of the materials being mixed/blended therein. However, other materials may be utilized for construction of the IBC, and may be specifically chosen for a particular application.

The cart 210 may additionally serve to position the V-shaped IBC 70 at a fixed height above the floor. The V-shaped IBC 70 may comprise first and second manway covers 74A and 74B that may be releasably removed or pivoted with respect to the bin portion of the IBC to permit filling therein of a first product 705 and a second product 706, which need to be blended together (see IBC 70B in FIG. 1, before blending has occurred), in order to form a homogenous substance 707 (see IBC 70A illustrating the bin after blending has occurred), where the first and second products may be powders, or granulates, and/or liquids. The cart 210 and IBC 70B may be wheeled up to the post-mounted blending machine 10. Once properly aligned, the floor-height-controlled IBC 70 may be advanced toward the machine 10, so that the flange 72 of boom 71 of the IBC may be received by the clamping structure 21, and be clamped therein as previously described.

The post-mounted mixing/blending machine 10 offers advantages over traditional style blenders, through its ability to raise or lower the blending vessel for loading/unloading and sampling. It also makes the mixing/blending user friendly, since ladders, mezzanines, and platforms can be eliminated, freeing up valuable floor space, as well as enhancing operator safety. The machine 20 can accommodate a variety of vessel sizes generally being up to a 40 cubic foot working capacity, and provides the ability to fill vessels in a dispensary, to blend in a separate suite, to discharge blended product directly into process equipment, and to finally wash the IBC in a dedicated area.

Once the ball/screw actuator 14 within post 11 thereafter causes vertical lifting of the machine portion 20 up to the height above which blending is to occur—above the blend nest structure 50 (see FIGS. 5A-5B), the dolly or cart (if not integral to the IBC) may be wheeled away. The machine portion 20 may then be lowered to engage the blend nest support structure 50, which may be actuated so as to be properly positioned prior to the downward movement of machine 20, as discussed hereinafter. The blend nest support structure 50 provides structural support for the machine portion 20 during the rotation of the IBC 70B (see FIGS. 6A-6D and 6I-6L) that results in blending of the products in the IBC, as high dynamic loading conditions may be created during these rotation and mixing operations.

The blend nest support structure 50 (see FIGS. 5A and 5B) may comprise left and right side vertical support beams 51L and 51R, which may have respective plates 52L and 52R welded to the bottom of the beams, which may be utilized to bolt those beams to the floor 201. Bracing beams 53L and 53R may have respective plates 54L and 54R welded to the bottom of the bracing beams, and which may also be bolted to the floor 201. The bracing beams 53L and 53R may have an upper end that is secured to the vertical beams 51L and 51R, to thereby provide support to the upper end of the vertical beams, and therefore also provides lateral support to the machine portion 20 that is distal from the machine's connection with the post 11. The upper portion of the vertical support beams 51L and 51R may each have a respective L-shaped nest fitting 55L/55R be pivotally secured thereon. Each of the nest fittings 55L/55R may have a base member 56L/56R of the "L" shape that protrudes away from the pivotally mounted portion of the nest fitting. The pivotally mounted nest fittings 55L/55R may be driven to pivot at selected times by respective linear actuators 57L/57R.

Figure 5B:
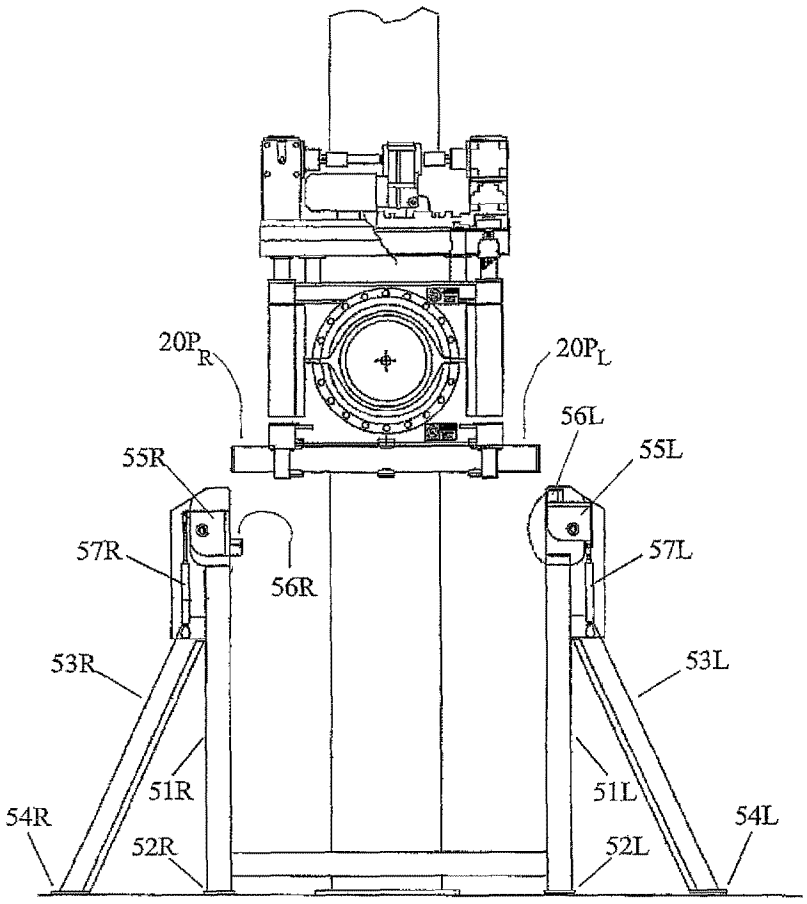
FIG. 5B is a front view of the post-mounted mixing/blending machine of FIG. 5A.
Figure 5E:
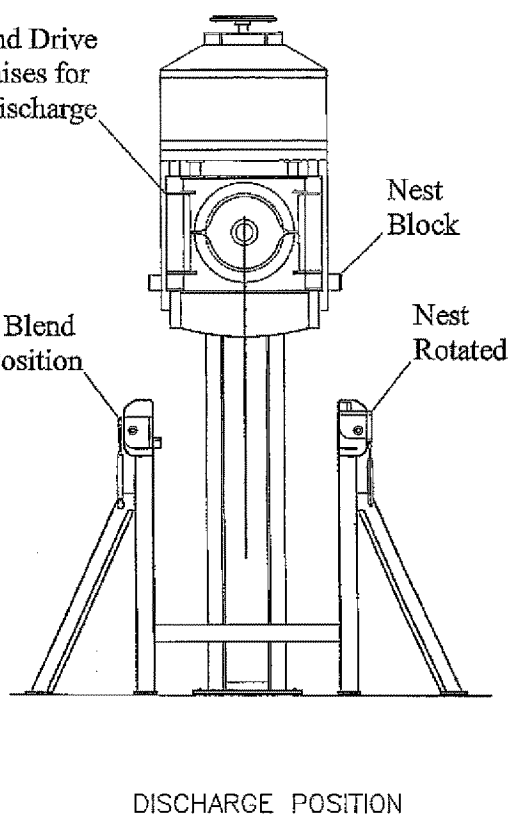
FIG. 5E is the front view of FIG. 5D, but shown with the mixing/blending machine raised to disengage from the blend nest structure and be elevated to a height permitting discharge of the mixed ingredients within the IBC.
Figure 5D:
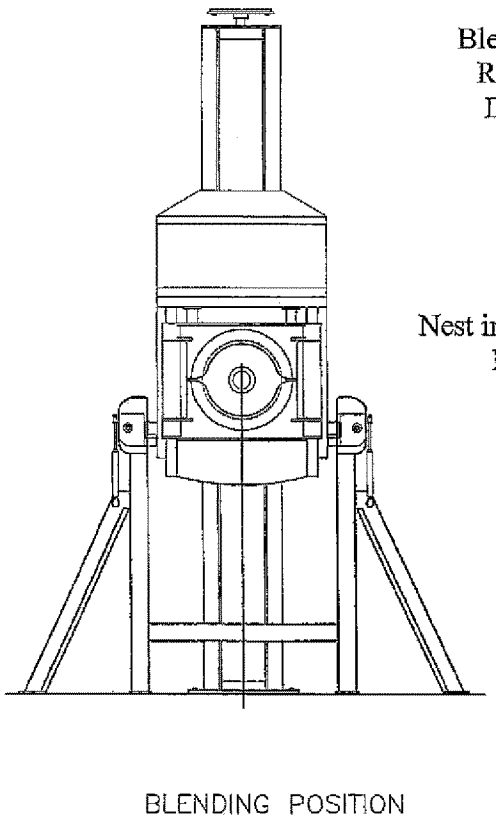
FIG. 5D is the front view of FIG. 5B, but shown with the mixing/blending machine raised to engage the blend nest structure.
Figure 5C:
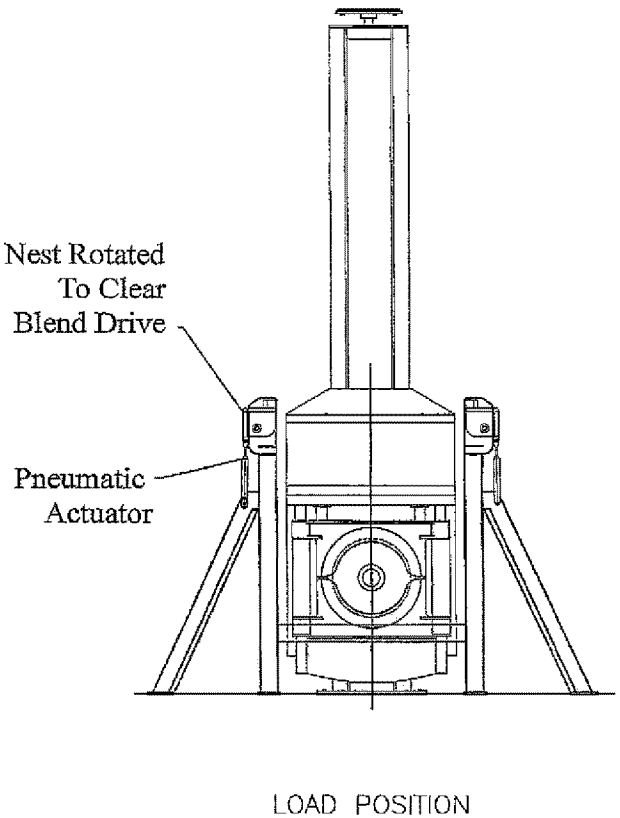
FIG. 5C is the front view of FIG. 5B, but shown with the mixing/blending machine in the lowered (loading) position.

When the machine 20 is in the load position (FIG. 5C), the pivotally mounted nest fittings 55L/55R may preferably be positioned as shown for the "left" side (55L) of the blend nest structure in FIG. 5B. After the machine 20 has secured the IBC within the clamping structure 21 at the load position, and after it has been temporarily elevated above the blend nest structure 50 (e.g., the discharge position of FIG. 5C), both of the pivotally mounted nest fittings 55L/55R may be driven by the respective linear actuators 57L/57R to pivot until positioned as shown for the "right" side (55L) of the blend nest structure in FIG. 5B. With both nest fittings 55L/55R occupying this position, when the machine 20 is lowered, the protruding portion of the machine on the left and right sides, 20$P_L$ and 20$P_R$, will contact and be supported by the base member 56L/56R of the "L" shape that protrudes away from the pivotally mounted portion of the nest fittings 55L/55R, and also be supported by the upstanding portion of the L-shape.

Figure 9:
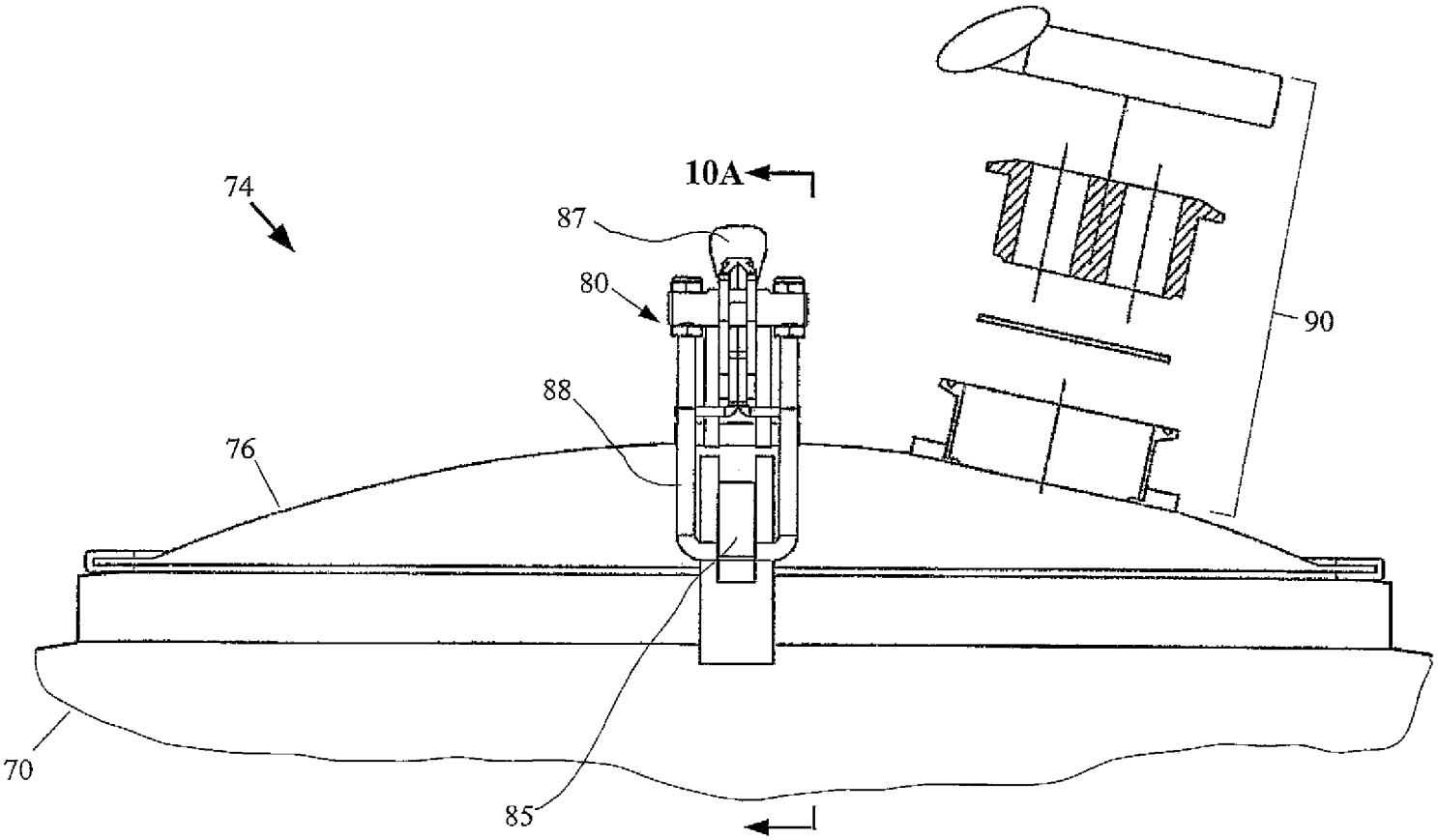
FIG. 9 is an end view of the manway for the IBC of FIG. 1.
Figure 10C:
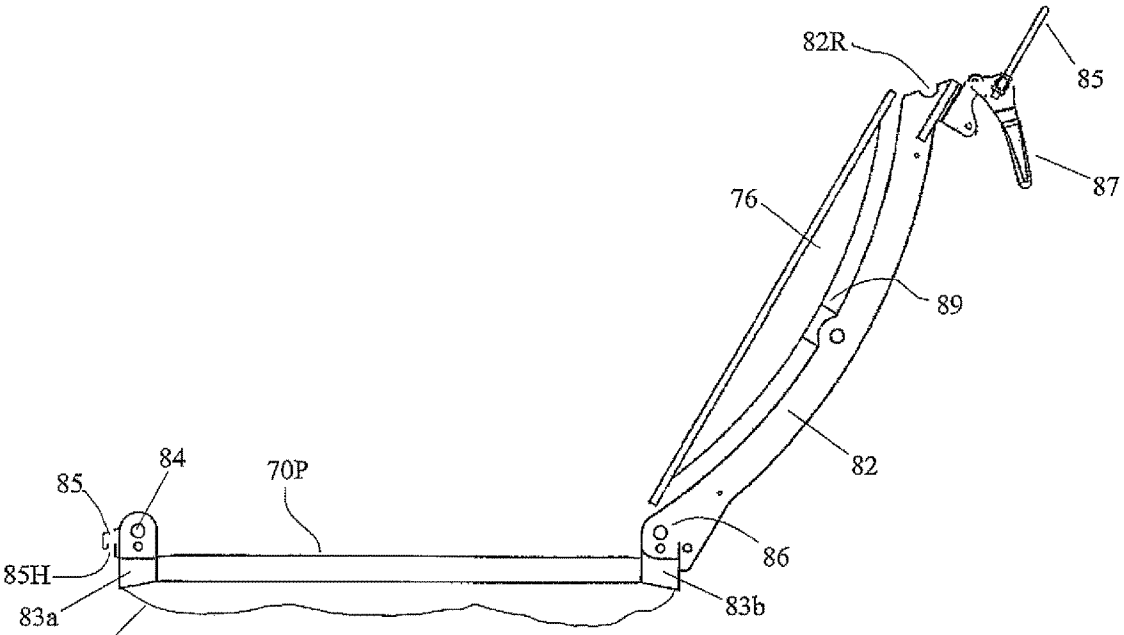
FIG. 10C is the manway side view of FIG. 10A, with the cover unlatched and pivoted into an open position.
Figure 10B:
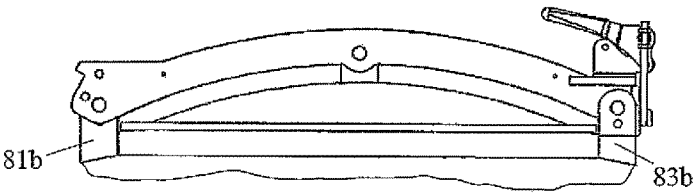
FIG. 10B is an opposite side view of the Manway of FIG. 9.
Figure 10A:
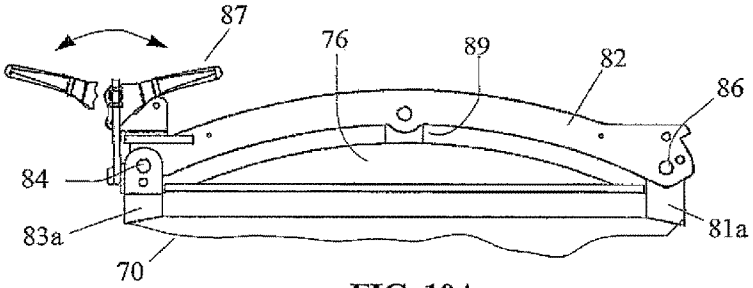
FIG. 10A is a side view of the manway of FIG. 9.

The manway cover assembly 74 of FIG. 1 is shown in detail within FIG. 9. The manway cover assembly may include a cover member 76, a clamp assembly 80, and also a filter assembly 90, with the components of the latter being shown in an exploded manner within the view. FIG. 10A shows a side view of the manway cover assembly 74 atop the IBC 70.

One side of the manway cover assembly 74 may comprise hinge support members 81*a* and 81*b* that protrude upward from the bin portion of the IBC 70, and may be integral with, or welded onto, the bin portion. An opposite side of the manway cover assembly 74 may comprise a pair of latch support members 83*a* and 83*b* that protrude upward from the bin portion of the IBC 70, and may be integral with, or welded onto, the bin portion. A rod 84 may span between and be fixedly connected to both of the latch support members 83*a* and 83*b*. Extending away from the rod 84 may be a plate 85 that may have a recess in the bottom periphery to form a hook 8511 (FIG. 10C).

A cover support arm 82 may have a first end that is pivotally connected with the hinge support members 81*a* and 81*b* using a pin 86. The cover member 76 may have a knob 89 protruding from a central position thereon, which may be secured to a center portion of the cover support arm 82, so that the cover member is cantilevered a small distance away from the arm. A second end of the cover support arm 82 may have a recess 82R therein, which, when the cover member 71 is pivoted from an open position (FIG. 10C) into a closed position (FIG. 10A), may engage the rod 84, as the cover member 76 contacts the opening 70P of the IBC 70. The height of the knob 89 may be adjusted so that the cover member 76 may engage the opening 70P of the IBC just prior to the engagement between the rod 84 and recess 82R, so that the cover member may thereafter be sealed tightly against the bin to prevent any ingredients being blended therein from leaking out.

A lever arm 87 may be pivotally mounted with respect to the second end of the cover support arm 82, so that a ring 88, which may comprise a rectangular shaped and which may be pivotally mounted to a protruding portion of the lever arm, may, when the cover member 71 is pivoted into the closed position, be rotated so as to be positioned below the hook portion 85H of plate 85. As the lever arm 87 is rotated from an unlocked position to a locked position (FIG. 10A), the ring enters within the hook portion 85H of plate 85, and further rotation of the lever arm into an over-center locked position causes engagement therebetween, with the cover member 76 sealing upon the opening 70P of the IBC.

The IBC, including the opening 70P of the IBC and the vent arrangement 90, is particularly adapted in the current invention to more advantageously prevent retention (clumping) of ingredients therein, both before mixing and even after mixing has occurred and the bin is to be inverted and emptied of all of its contents. One goal of this aspect of the invention is to reduce cavities caused by perpendicular surfaces, which is further assisted by having the surface of the blending vessel be as smooth as possible. Any penetrations that have traditionally been made into the IBC have comprised circular cutouts, with tube or pipe that may be capped with circular covers or valves. Any "pockets" (or recesses) created by such penetrations can undesirably collect compacted product that may not initially enter or subsequently re-enter the mix. The smaller the diameter of the penetration, the more likely it will collect product. This drawback of the prior art is exacerbated by the fact that the trend in drug manufacturing is toward smaller ratios of active vs. inert ingredients. If the active ingredient is trapped in such a cavity prior to or during mixing, it can significantly alter the outcome of the blend.

Figure 11A:
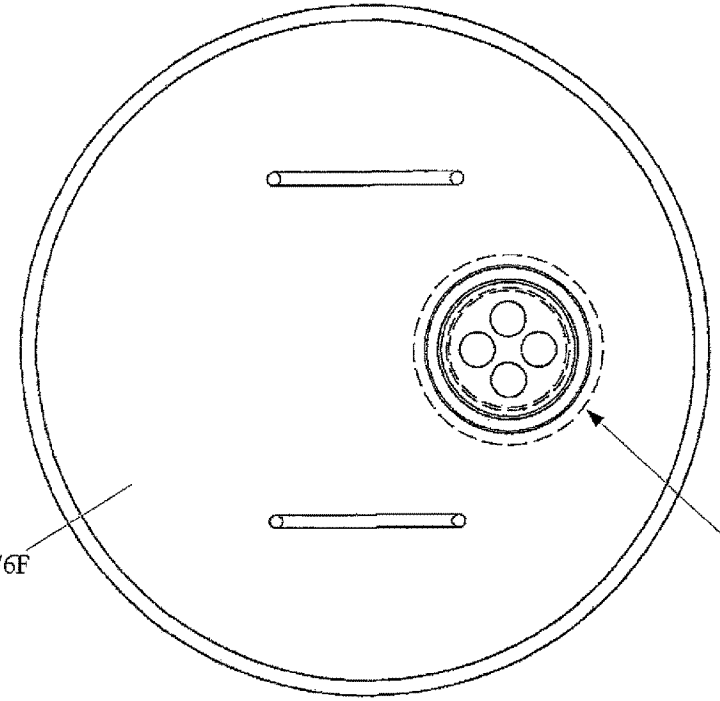
FIG. 11A is a top view of an alternate embodiment of a manway cover assembly of the present invention.
Figure 11B:
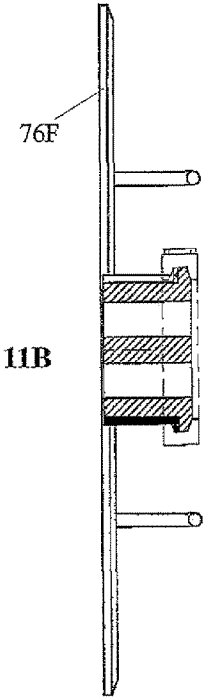
FIG. 11B is a cross-sectional view through the vent of the manway cover of FIG. 11A.
Figure 11C:
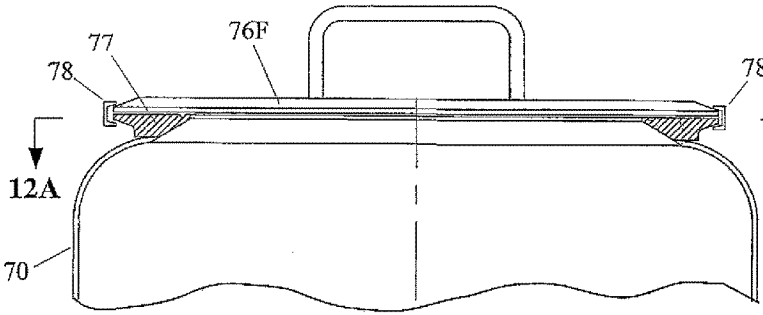
FIG. 11C is a cross-sectional view through an IBC and the manway cover of FIG. 11A.
Figure 11D:
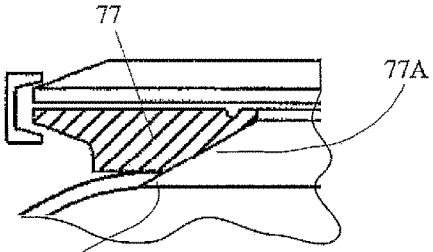
FIG. 11D is the cross-sectional view of FIG. 11C enlarged to show the detail of one end of the cross-section.
Figure 11E:
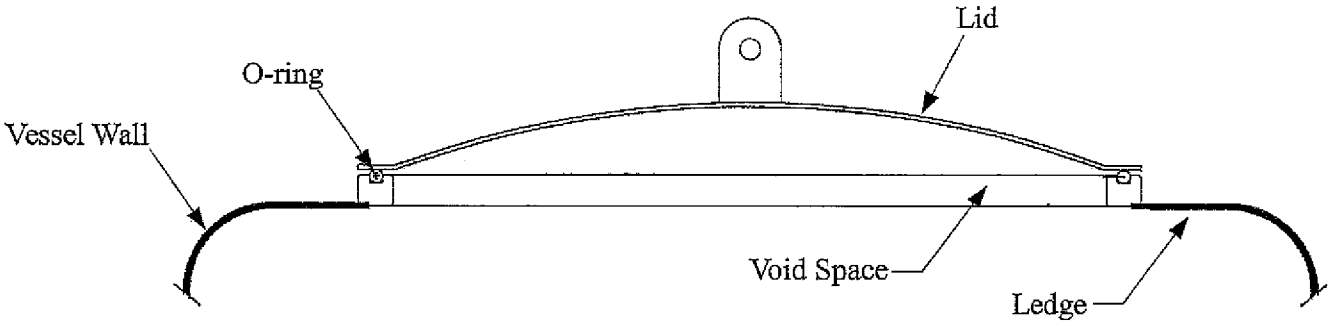
FIG. 11E is a cross-sectional view through a prior art lid arrangement.
Figure 12A:
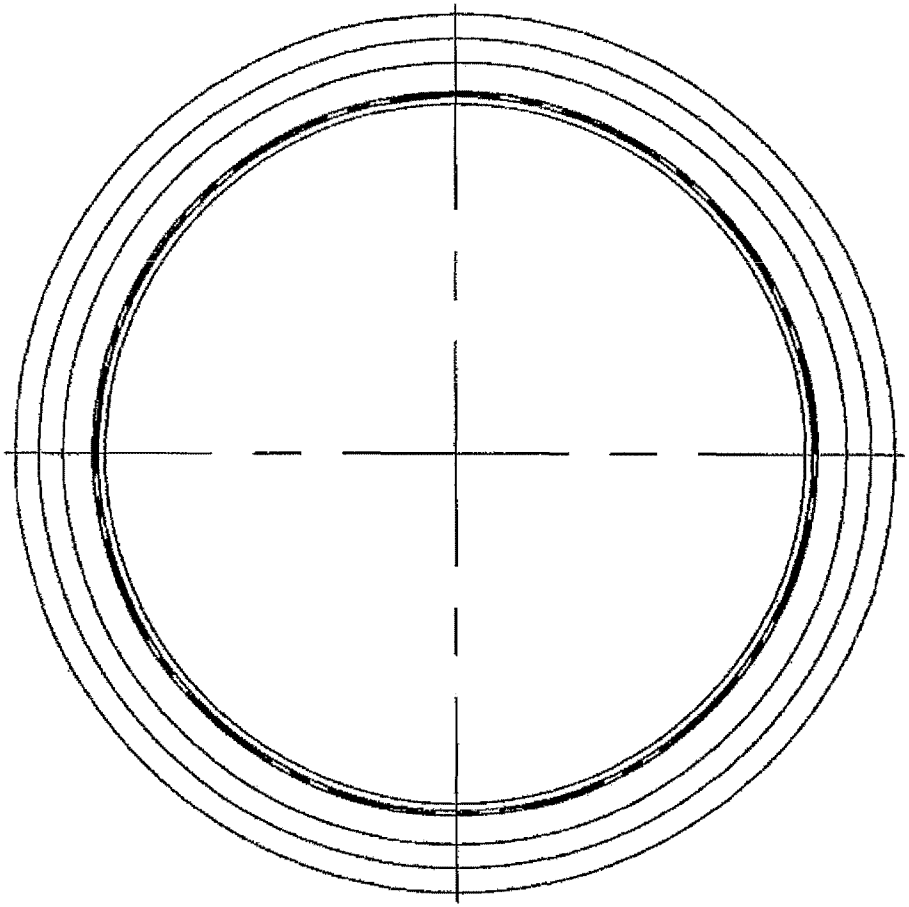
FIG. 12A is a view looking down at the flange of the bin of FIG. 11C.
Figure 12B:
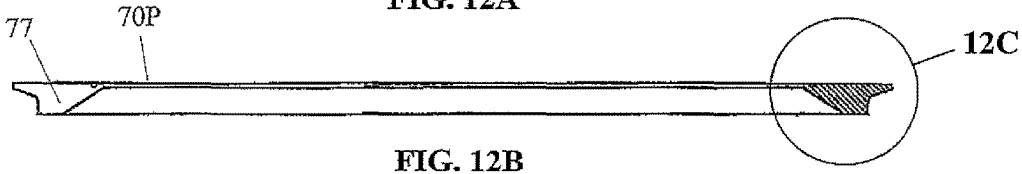
FIG. 12B is a cross-sectional view through the flange cross-section of FIG. 12A.
Figure 12C:
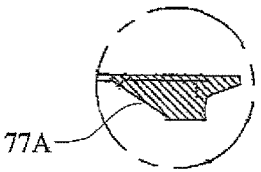
FIG. 12C is and enlarged detail view of one end of the flange of FIG. 12B.

The arrangement of the current invention reduces or eliminates perpendicular surfaces for the bin cover region, and is illustrated initially within FIG. 11C, in which a flat cover 76F is shown sealing the opening of the IBC. The IBC 70 may have the final opening 70P be formed by welding a flange 77 atop the curved section of the bin portion. A continuous weld may be used about the interior periphery of the joint, and an intermittent weld may additionally be used about the exterior periphery of the joint. The flange 77 may preferably be constructed to have a surface 77A be angled downward towards an edge 70B of the bin portion, which assists in the removal of the blended ingredients and prevents aggregation or clumping at any time, because there are no perpendicular surfaces creating ledges and pockets where ingredients may have the tendency to become clogged particularly at the beginning, but also throughout the mixing process. FIG. 11E illustrates a prior art lid arrangement, and shows how the ledge transitions directly into a perpendicular recess at the opening of the IBC, that forms a void space susceptible to being clogged by one of two or more ingredients that need to be blended together.

Figure 13B:
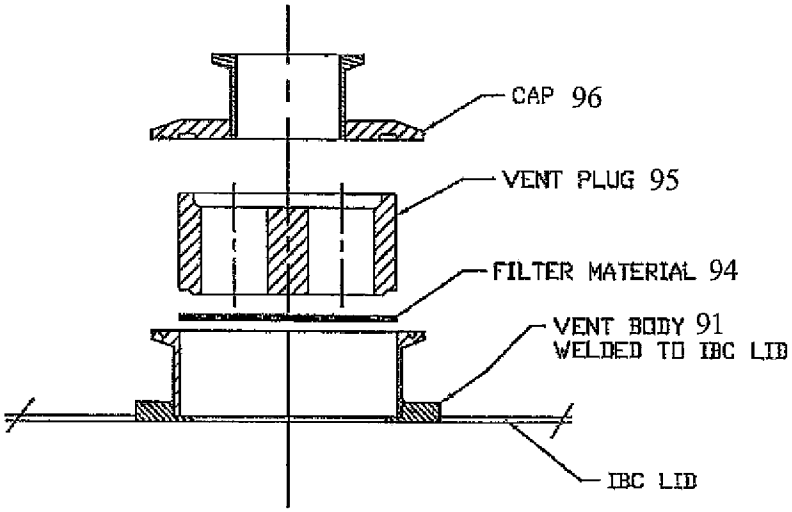
FIG. 13B is an exploded view of the vent assembly of FIG. 13A.
Figure 13A:
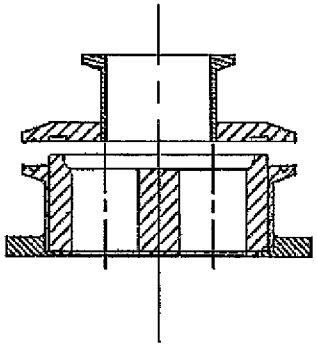
FIG. 13A is a detail view of the vent assembly of FIG. 11B, with the cap removed.
Figure 13D:
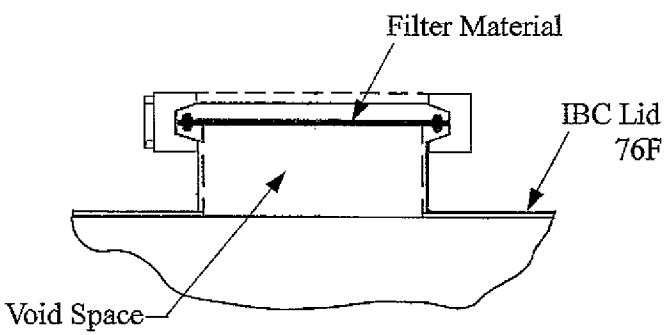
FIG. 13D is a cross-section illustrating the prior art vent arrangement.
Figure 13C:
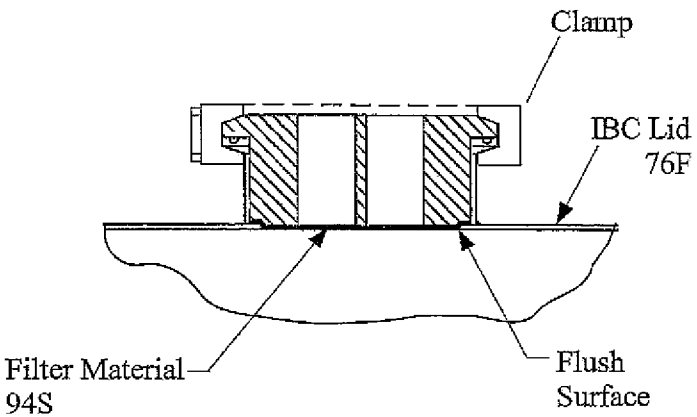
FIG. 13C is a cross-sectional view through an alternate embodiment of the vent assembly of FIG. 13A.
Figure 14A:
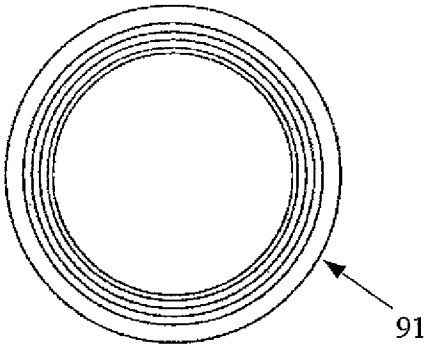
FIG. 14A is a top view of the vent body of the vent assembly of FIG. 13A.
Figure 14B:
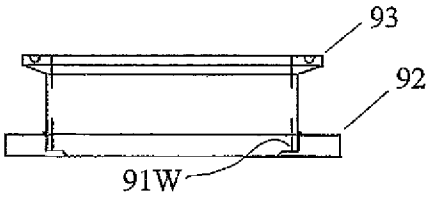
FIG. 14B is a cross-sectional view through the welded vent body of FIG. 14A.
Figure 14C:
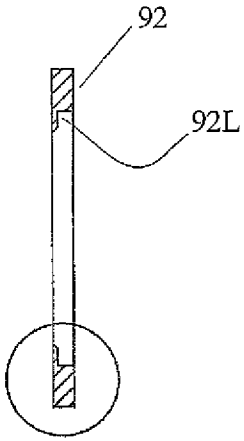
FIG. 14C is a cross-sectional view through the base plate of the welded vent body of FIG. 14B.
Figure 14D:
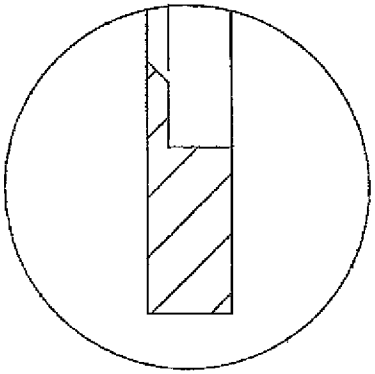
FIG. 14D is an enlarged detail view of one side of the base plate cross-section of FIG. 14C.
Figure 15A:
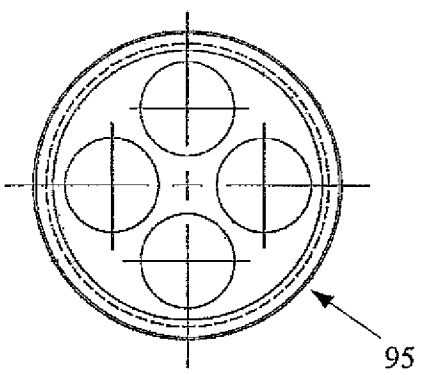
FIG. 15A is a top view of the plug of the vent assembly of FIG. 13B.
Figure 15B:
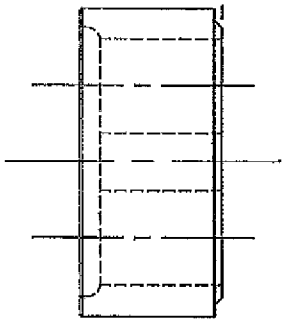
FIG. 15B is a side view of the plug of FIG. 15A.
Figure 15C:
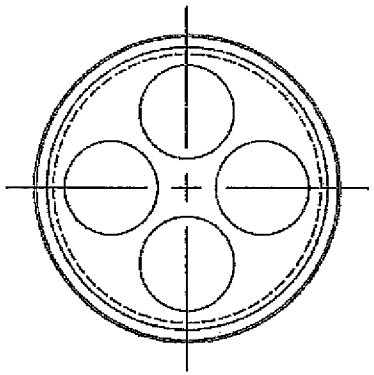
FIG. 15C is a bottom view of the plug of FIG. 15B.
Figure 15D:
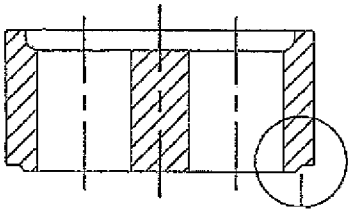
FIG. 15D is a cross-sectional view through the plug of FIG. 15A.
Figure 15E:
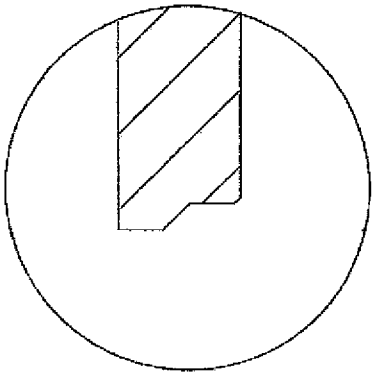
FIG. 15E is an enlarged detail view of one side of the plug cross-section of FIG. 15E.

The parts of the vent assembly 90 in the exploded view of FIG. 9 are similarly shown in FIGS. 13A and 13B. The vent assembly 90 permits equalization of pressures between the inside of the IBC during blending and the container's exterior. As seen in FIG. 13B, the vent assembly may comprise a vent body 91, a filter 94, a vent plug 95, and a cap 96. The vent body 91 is shown in detail within FIGS. 14A-14D, and may include a disk-shaped base 92 with an orifice therein creating a very shallow lip 92L, that receives a hollow body cylinder member 93, both of which may preferably be formed of grade 316 stainless steel. The vent body 91 may be formed by having a fuse weld 91W between the body cylinder member 93 and the lip 92L of the disk-shaped base 92. The filter 94 may be disk-shaped having a cylindrical periphery being sized to fit within the interior of the hollow body cylinder member 93, but nonetheless be large enough to engage and rest upon the lip 92L of disk-shaped base 92. The filter may be secured therein by the plug 95, which is shown in detail within FIGS. 15A-15E, and may be formed of a high density polyethylene material to have four large vent openings therein. The filter and plug 95 may be retained within the vent body 91 using the cap 96, which is shown in detail within FIGS. 16A-16C. The cap 96, which may also be formed of grade 316 stainless steel, may be secured to the vent body 91 using threading, or a clamp, or using any other suitable means of attachment. An alternative embodiment of the filter is shown within FIG. 13C, in which the filter 94S has a circular step that allows the inward facing side of the filter to be coterminous with the IBC cover or the IBC wall (depending upon its positioning), so as to eliminate even the reduced pocket that would otherwise be formed by the filter resting upon the very shallow lip 92 in the first embodiment. The arrangement of FIG. 13C produces a flush interior surface for the IBC even at the filter, as opposed to the large void space of the prior art filter arrangement that is illustrated in FIG. 13D.

Figure 17A:
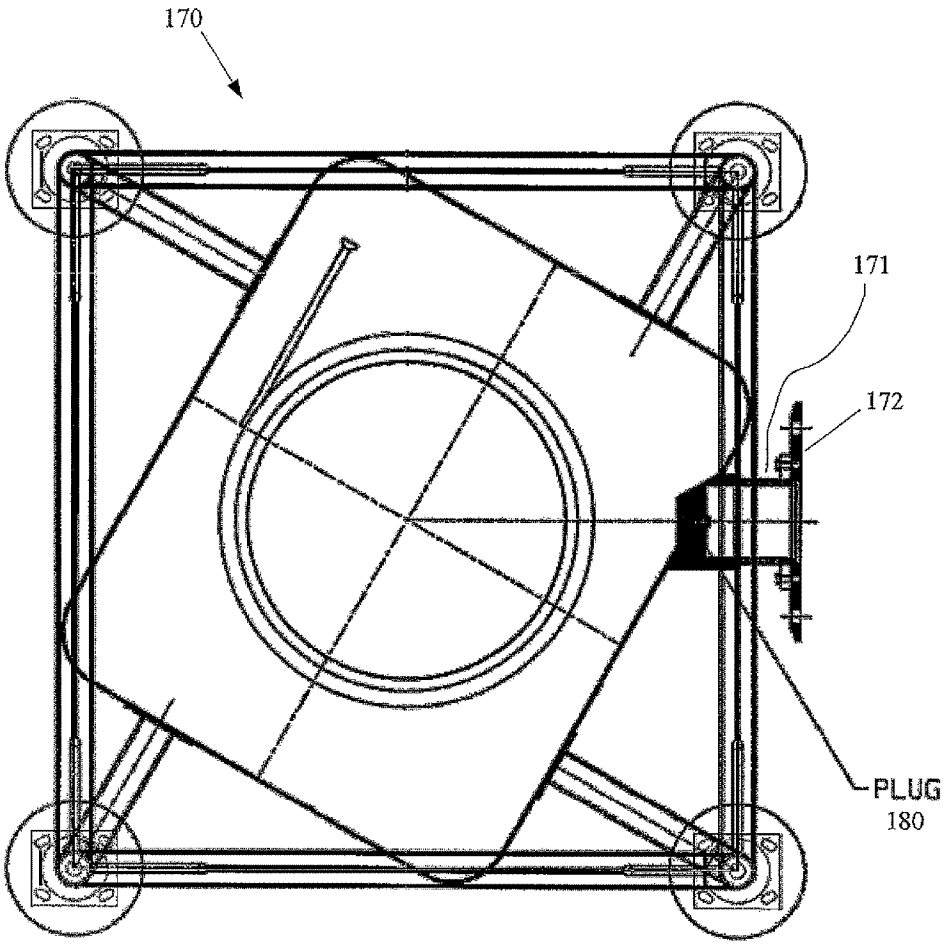
FIG. 17A is a top view of an IBC having an integral wheeled-frame, and being shown with the cover removed, and having a plug within the receptacle of the boom.

FIG. 17A illustrates a top view of an IBC 170 that has a wheeled-frame incorporated into its construction, a frame that is not intended to be removed during the blending process, and conversely unifies the loading and unloading procedure by eliminating the need to precisely dock a separate dolly beneath the IBC 170 after mixing. Therefore, the blending machine 10 is designed to be capable of supporting the weight of the IBC 170, both as to its initial lifting, as well as for the dynamic loading experienced during the rotation of the IBC to cause mixing/blending of any ingredients contained therein. The IBC 170 in FIG. 17A is shown with the cover removed to expose the interior of the bin portion of the IBC. The IBC 170 in FIG. 17A has a plug 180 positioned within the boom 171 to seal an opening between the interior of the bin and the boom. The flange 172 of the boom 171 may be used to clamp the IBC 170 to the blending machine 10, as seen in FIG. 7C. IBC 170 may be used for the mixing of ingredients, where the mixing occurs solely from the rotation of the bin by the machine, and where no intensifier bar is utilized with the IBC.

Figure 6A:
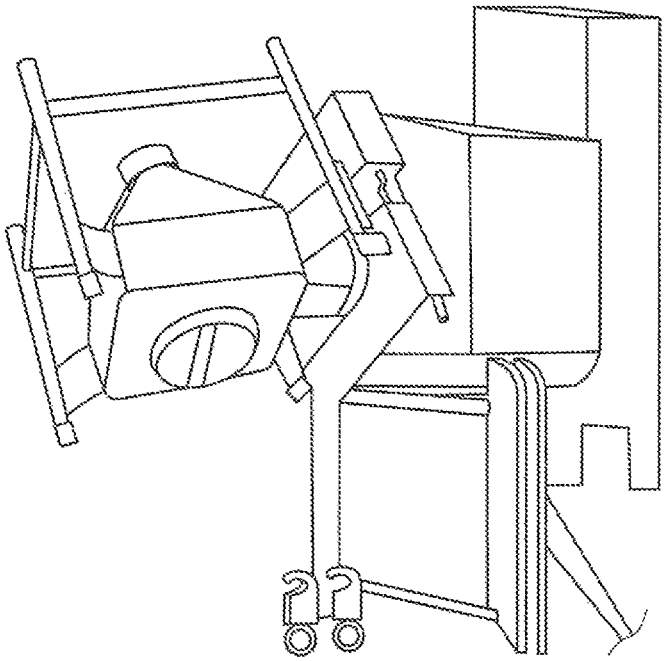
FIG. 6A shows a frame-mounted IBC that is clamped within the mixing/blending machine, which is secured within the blending nest support arrangement, as the IBC is initially being rotated.
Figure 6B:
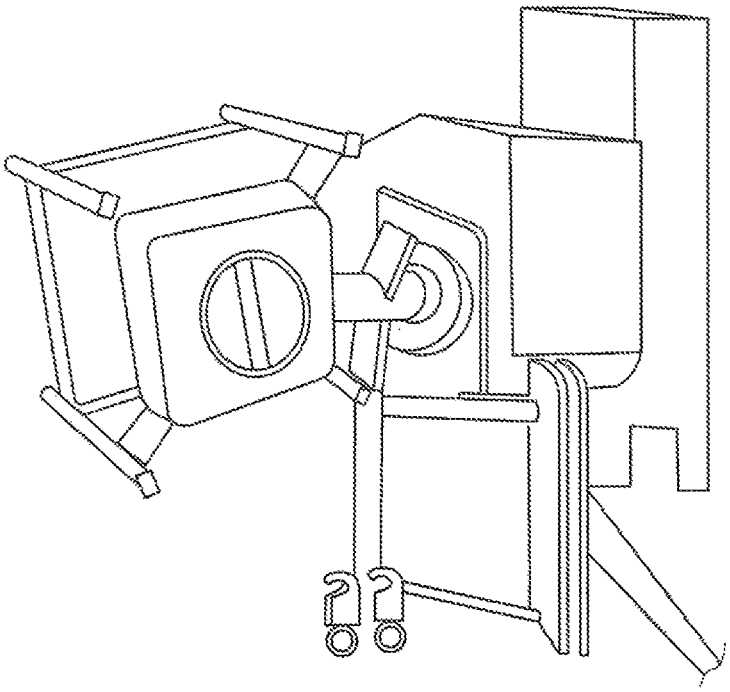
FIG. 6B shows the frame-mounted and clamped IBC of FIG. 6A, after roughly one-quarter of a full rotation of the IBC.
Figure 6C:
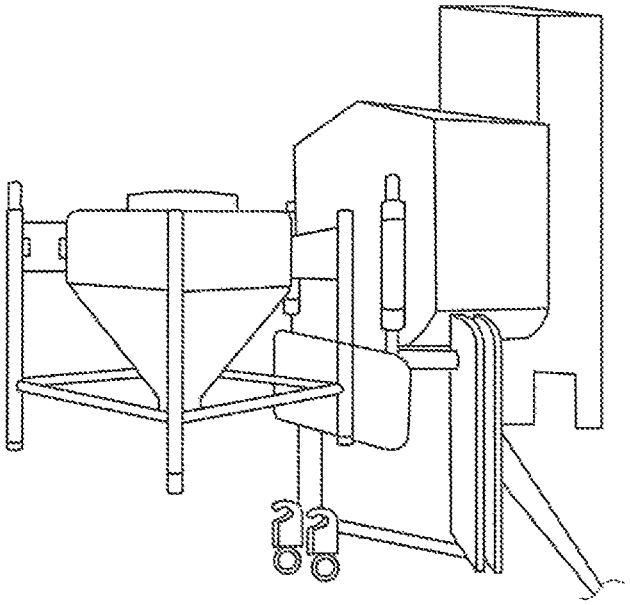
FIG. 6C shows the frame-mounted and clamped IBC of FIG. 6B, after roughly one-half of a full rotation of the IBC.
Figure 6D:
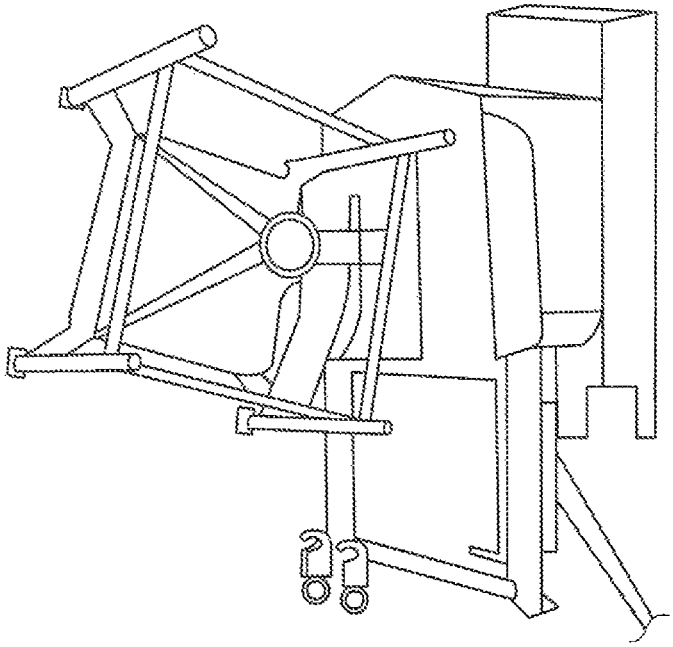
FIG. 6D shows the frame-mounted and clamped IBC of FIG. 6A, after roughly three-quarters of a full rotation of the IBC.
Figure 6E:
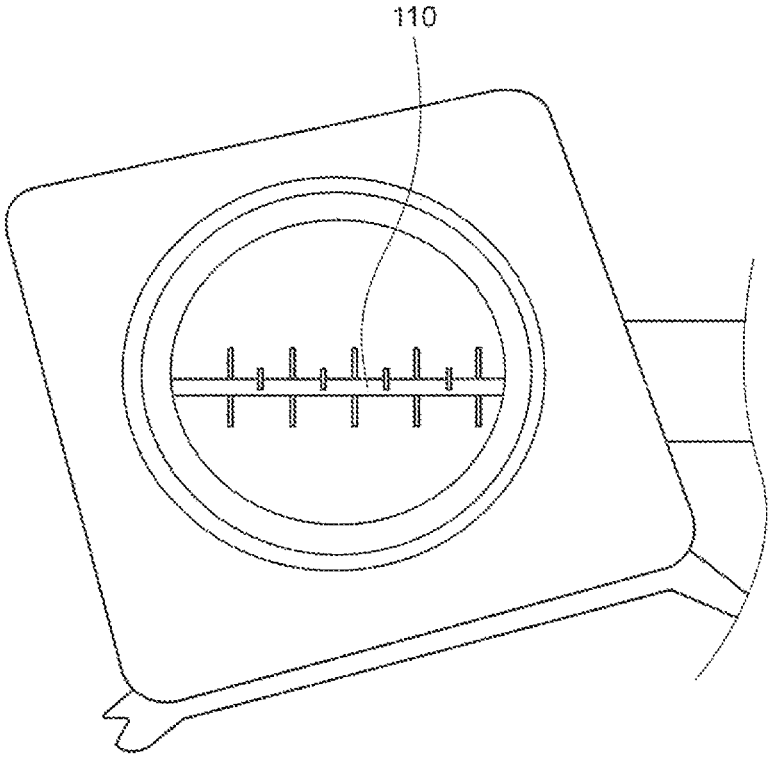
FIG. 6E shows the frame-mounted and clamped IBC of FIG. 6A, with the bin cover assembly removed, and being rotated to expose the high speed mixing bar spinning within the IBC.
Figure 6I:
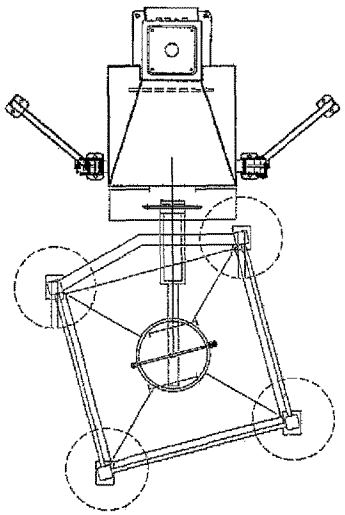
FIG. 6I is a top view of the mixing/blending machine of FIG. 6G, with the boom of a frame mounted IBC clamped within the mixing/blending machine.
Figure 6F:
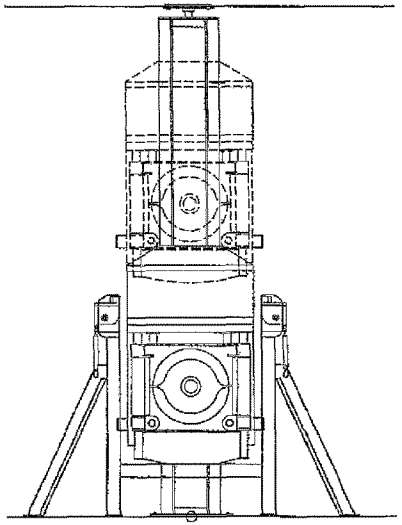
FIG. 6F is the front view of FIG. 5E, but illustrating boom-docking and IBC discharge heights for the mixing/blending machine.
Figure 6G:
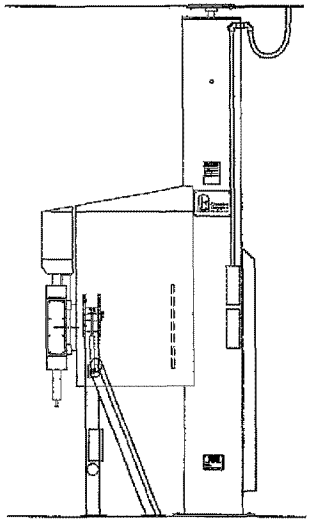
FIG. 6G is a side view of the mixing/blending machine of FIG. 6G.
Figure 6H:
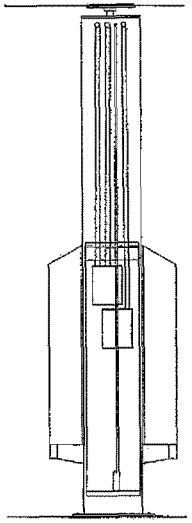
FIG. 6H is a rear view of the mixing/blending machine of FIG. 6G.
Figure 6L:
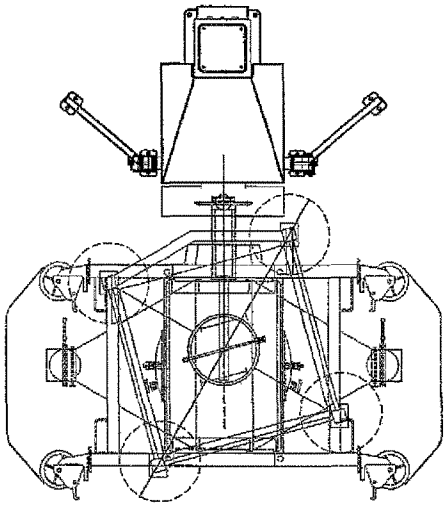
FIG. 6L is a top view of the mixing/blending machine of FIG. 6K, with the frame/dolly-mounted IBC clamped within the machine.
Figure 6J:
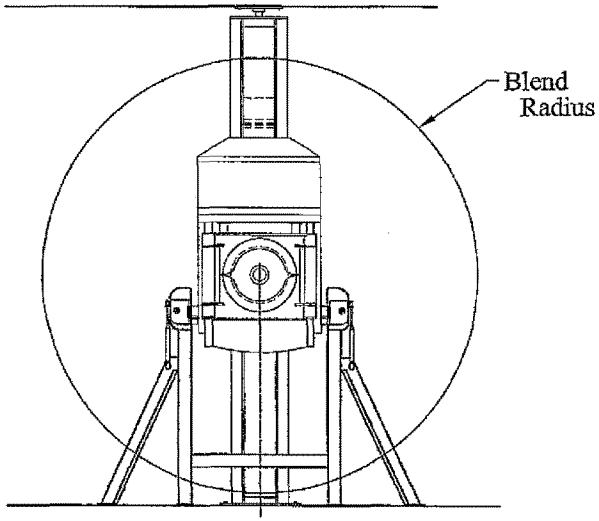
FIG. 6J is the front view of FIG. 5D with the mixing/blending machine secured within the blend nest structure, and showing the blending radius for an IBC that may be clamped to the machine, and clearance to the floor and from the ceiling.
Figure 6K:
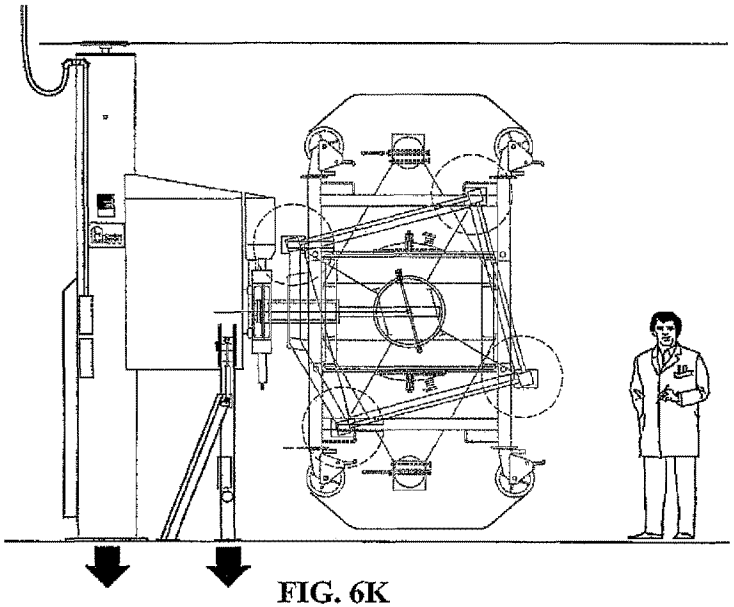
FIG. 6K is a side view of the mixing/blending machine of FIG. 6J, showing a frame/dolly-mounted IBC clamped within the machine, and being at upper extreme and lower extreme rotational positions to illustrate floor and ceiling clearances.
Figure 17B:
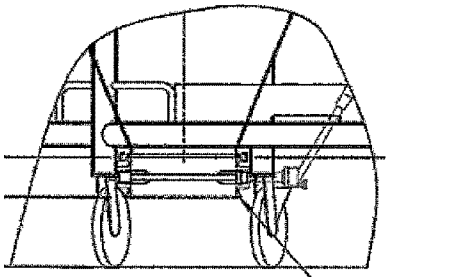
FIG. 17B is a detail view of the wheel arrangement and the discharge valve of the IBC of FIG. 17A.
Figure 17C:
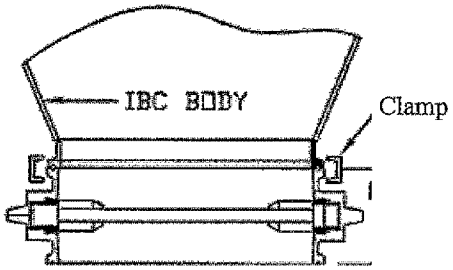
FIG. 17C is a detail view of the discharge valve of the IBC of FIG. 17B.
Figure 17D:
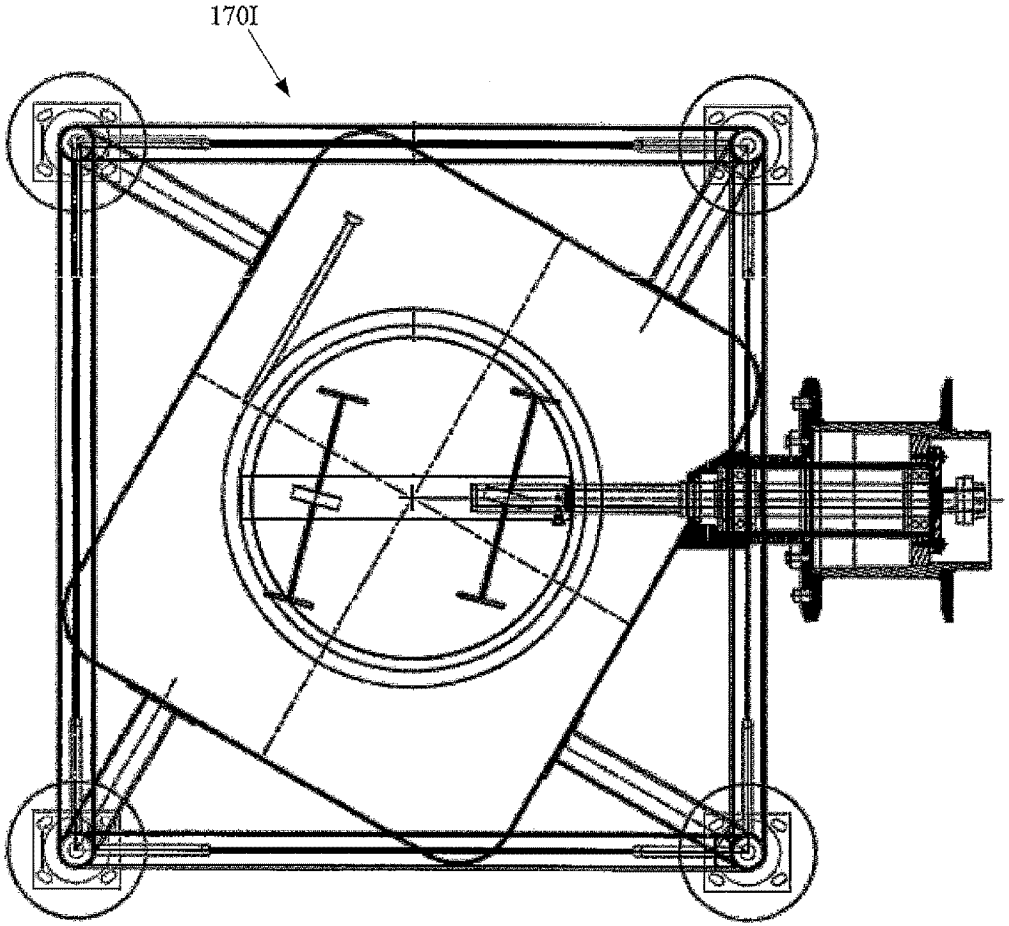
FIG. 17D is the top view of the IBC of FIG. 17A, but with the plug removed and replaced with a bin solid intensifier bar within the bin and being shown therein in cross-section, and with it being connected to a drive shaft and bearing cartridge that are secured within the boom of the IBC.
Figure 17E:
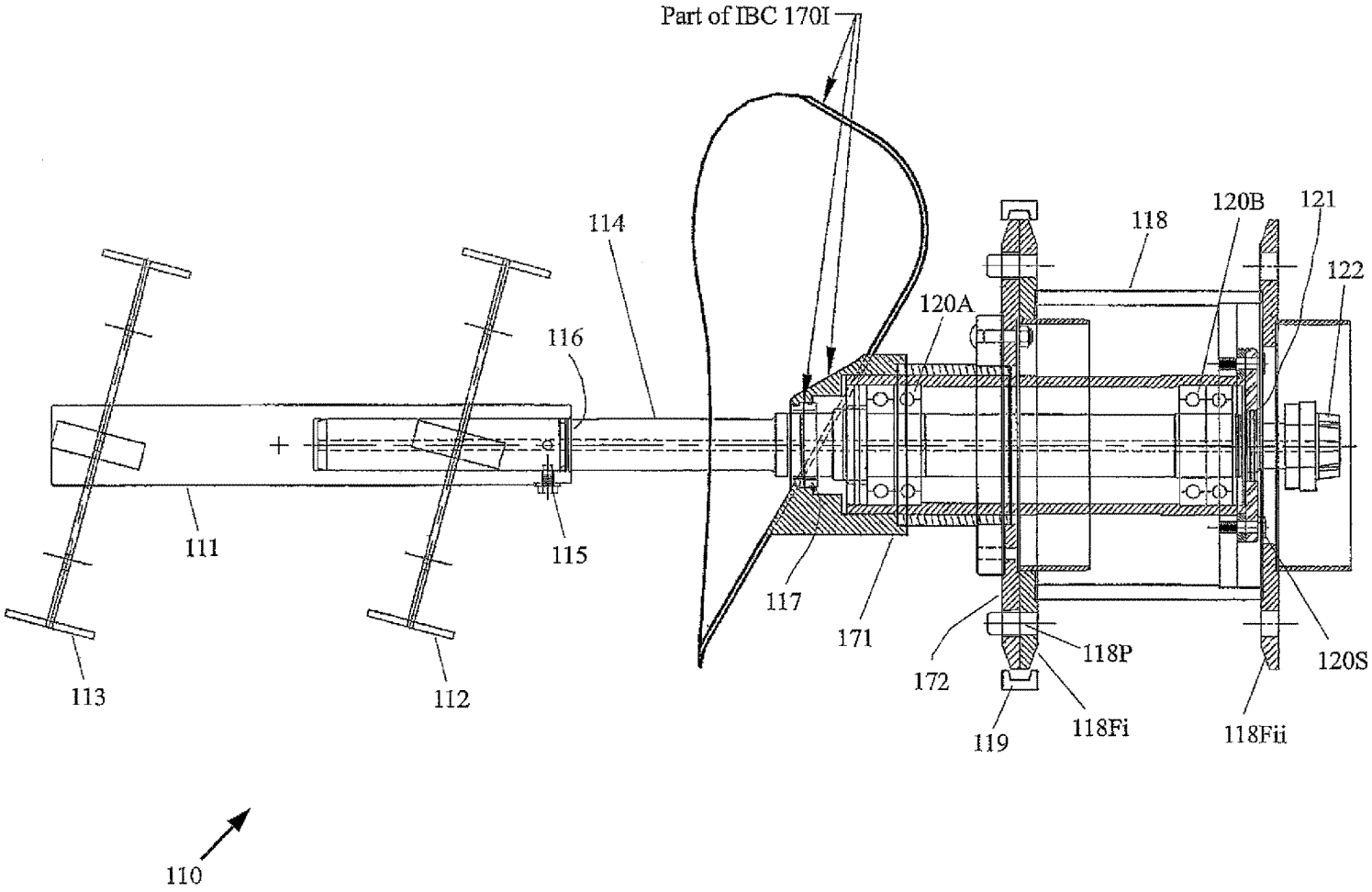
FIG. 17E is the IBC of FIG. 17D, but with most of the IBC container cut away and being enlarged to show the component parts of the intensifier bar.
Figure 19:
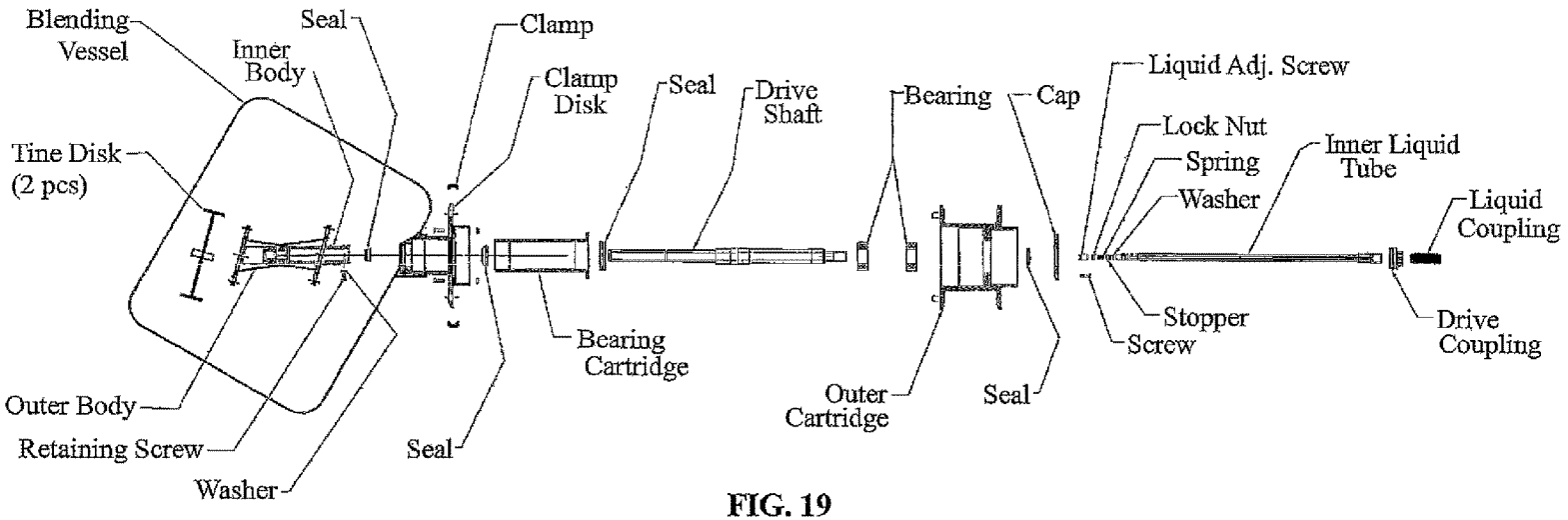
FIG. 19 is an exploded cross-sectional view of the parts of the bin liquids intensifier bar of FIG. 18A.
Figure 20:
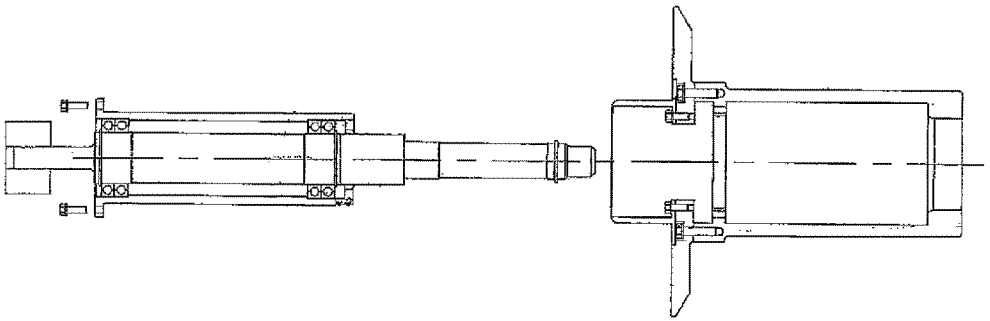
FIG. 20 is an enlarged cross-sectional view of the bearing cartridge and drive shaft prior to installation into the outer cartridge of the bin of the bin liquids intensifier bar of FIG. 18A.
Figure 21:
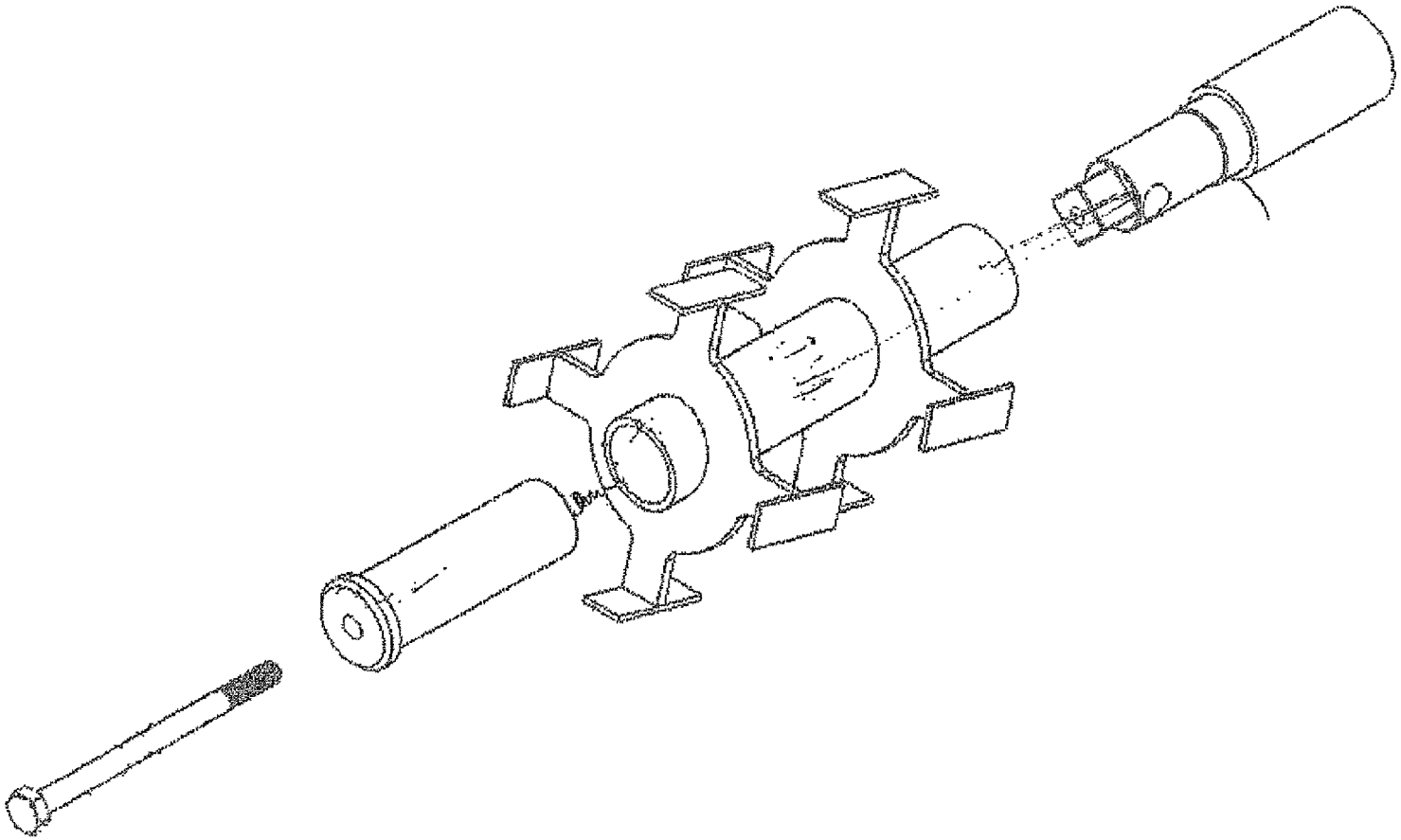
FIG. 21 is an exploded view of a second alternative embodiment for the I-bar for the bin liquids intensifier bar.

Conversely, as seen within FIGS. 1, 6E, and 17B, a blending intensifier bar or high speed mixing bar 110 may be utilized to cause blending of the ingredients contained within the IBC, in addition to the mixing that is caused by the rotation of the IBC. The IBC 170 of FIG. 17A may be utilized with an intensifier bar 110, by removing the plug 180, and by adding the component parts for the intensifier bar, to result in the IBC 170I of FIG. 17D. Intensifier bar 110 may be releasably connected through the boom 171 of the IBC 170F. FIG. 17E shows the component parts of the intensifier bar 110, with significant portions of the IBC bin having been cut away to expose those components. The intensifier bar assembly 110 may comprise a disk support shaft 111, which may have a pair of I-shaped tine disks 112 and 113 secured thereon. The disk support shaft 111 with tine disks 112/113 thereon may be positioned within the interior of the IBC, and may therein be releasably mounted upon a first end of drive shaft 114 that has been inserted through the opening in boom 171 that had previously been occupied by plug 180. The disk support shaft 111 may be releasably secured to the drive shaft using a retaining screw 115. A seal 116 may prevent the ingredients to be mixed from entering into the drive shaft-to-disk support shaft interface, while a seal 117 may similarly prevent ingredients from leaking out the interface between the IBC boom 171 and the drive shaft 114. An outer cartridge 118 may be secured to the flange 172 of the boom 171 of the IBC 170I, by a series of holes in the flange 172 receiving a series of corresponding integral pins 118P protruding from flange 118Fi of the outer cartridge 188, and by using clamp(s) 119. One end of a bearing cartridge 120, which comprises bearings 120A and 120B, may be secured within the boom 171, while the other end of the bearing cartridge may be secured to the outer cartridge 118 using screws 120S (see the alternate embodiment construction shown within FIGS. 19 and 20). A seal 121 may redundantly serve to prevent any ingredients from exiting from the drive shaft-to-bearing cartridge interface within the outer cartridge 118, as well as serving to prevent any contaminates from entering therein. A second end of the drive shaft 114, being distal from the disk support member 111, may have a drive coupling 122 secured thereon. When the IBC 170I is to be loaded into (mated with) the blending machine 10, the flange 118Fii of the outer cartridge 118 is advanced toward the machine portion 20 of blending machine 10 to be clamped therein, as discussed previously and illustrated within FIG. 7C, and the drive coupling 122 is simultaneously received within a corresponding coupling 40 (see FIG. 1A). The clamping of the flange 118F of the outer cartridge 118 with the machine portion 20 permits a drive motor therein to cause rotation of the IBC 170I. Rotation speeds may typically be roughly 1.5 meters per second, as measured at the greatest radius of the IBC (see FIGS. 6J-6L), while another drive motor may cause the connection between coupling 40 of the machine portion 20 to independently the drive coupling 122 of the intensifier bar 110 to cause higher speed rotation of the drive shaft 114 and the I-shaped tine disks 112/113, to thereby intensify mixing of the ingredients within the interior of the IBC during rotation of the IBC. The high speed rotation of the drive shaft 114 may be in the same direction as that of the IBC itself (See FIG. 1), and may be accommodated relative to the surrounding components by the bearings 120A and 120B of bearing cartridge 120. Typical rotation speeds for the intensifier bar may be roughly 15 m/s, as measured at the outer diameter of the tine discs 112/113.

Figure 18A:
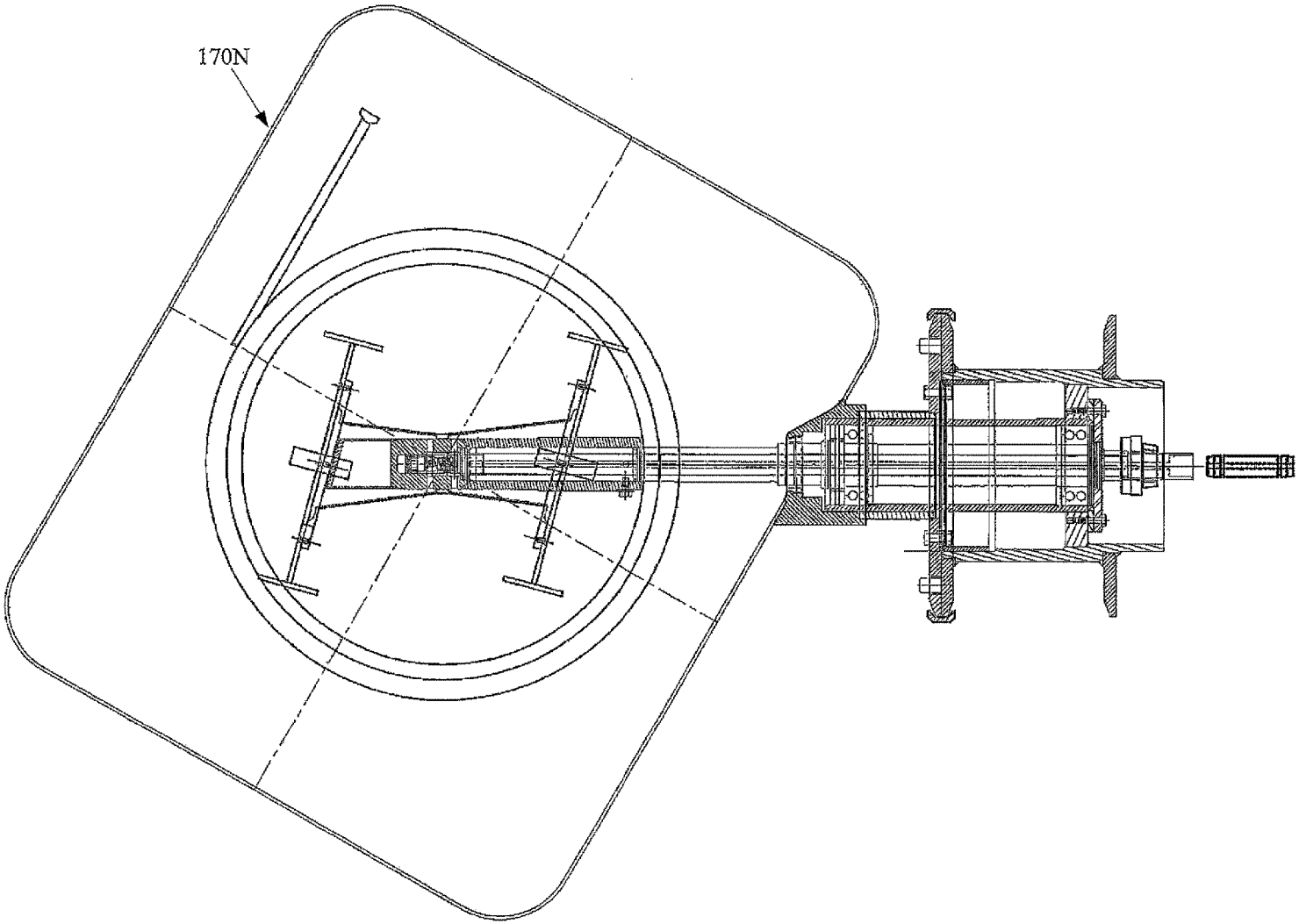
FIG. 18A illustrates a top view of an alternative IBC being without an integral frame, and having a liquid intensifier bar within the bin, and being shown therein in cross-section, and with it being connected to a drive shaft and bearing cartridge that are secured within the boom of the IBC.

FIG. 18A shows an alternate embodiment of the high speed mixing bar 110, being in the form of a bin liquids intensifier bar assembly 210 that, merely to be exemplary, is used in conjunction with an IBC 170N having no integral framework. The bin liquids intensifier bar assembly 210 is shown enlarged within FIG. 18B, where the bin portion has been mostly cut away. The high speed mixing intensifier assembly 210 may be largely constructed the same as the bin solids intensifier assembly 110. The component parts of the bin liquids intensifier bar assembly 210 are illustrated separately in the exploded view of FIG. 19. One distinction between the bin solids mixing bar 110 and bin liquids intensifier bar assembly 210 is that the latter may comprise a hollow drive shaft 214 that may have a fluidic connection, through machine 20, with the liquid feed assembly 150 of FIGS. 22A-22C, using fluid coupling 223. Fluid coupling 223 may be disposed between the drive coupling 222 of the intensifier bar 220 and the coupling 40 of the machine portion 20 to permit fluid transfer therebetween, and will be discussed further hereinafter.

Another distinction between the bin solids mixing bar 110 and bin liquids intensifier bar assembly 210 is that for the latter, the disk support member is replaced with a disk support and flow control member 211, which comprises a pair of opposingly oriented conical surfaces 211Ci and 211Cii that may create a conduit that serves to direct the flow of a liquid introduced through the hollow shaft 211, a liquid which is to be introduced into the powder or granulate within the bin. FIG. 18C shows an enlarged view of the cross-section and the fluid flow path that permits the intensifier bar 210 to achieve such mixing.

The disk support and flow control member 211 may have a central shaft portion 211R upon which the joining point 211J of the conical surfaces 211Ci and 211Cii may be secured (note that the conical surface may have a portion of its other end be secured to the I-shaped tine disks 212 and 213). The central shaft portion 211R may have a multi-cylindrical cylindrical chamber 211B therein (see FIG. 18D). The drive shaft 214 may have an opening 214H running the length of the shaft so as to form a hollow shaft, which may terminate within the disk support and flow control member 211, so that the multi-cylindrical cylindrical chamber 211B therein may be in fluid communication with the opening 214H in drive shaft 214. The drive shaft 214 may be secured within the disk support and flow control member 211 using a retaining screw 215.

Figure 18B:
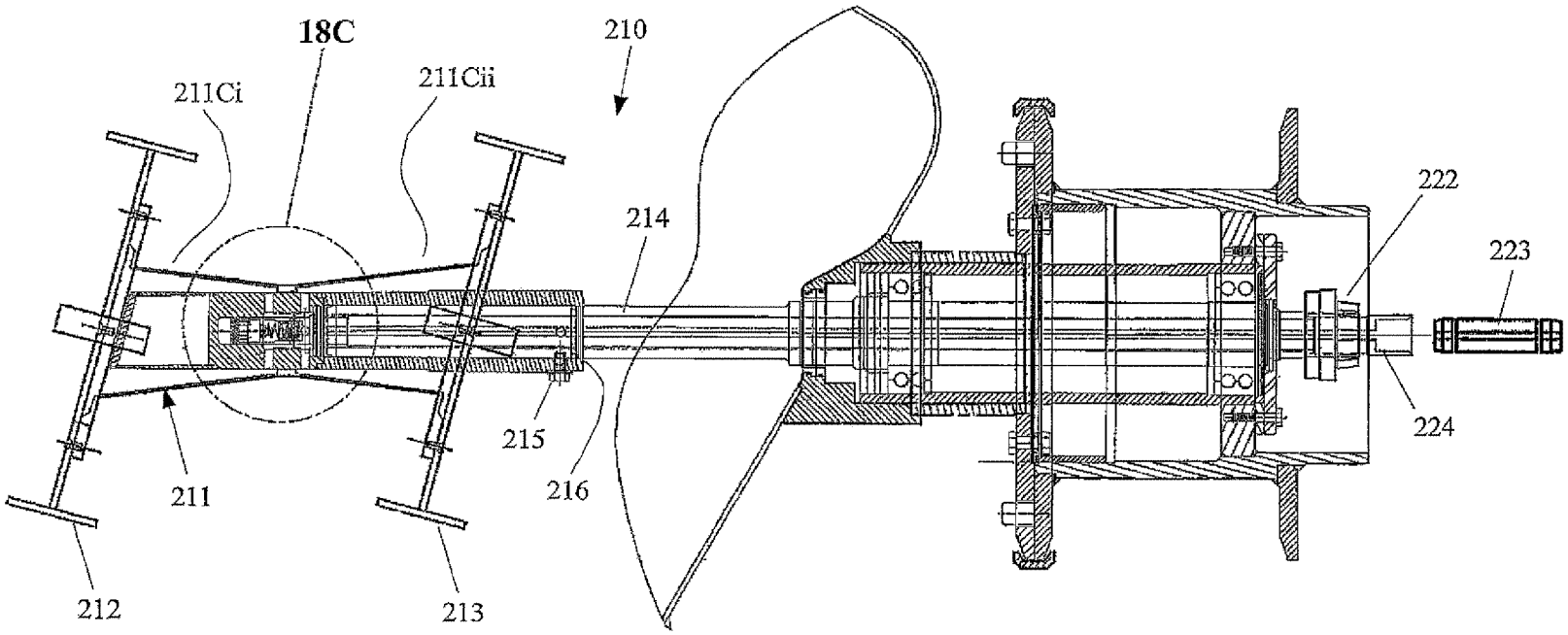
FIG. 18B is the top view of FIG. 18A, but shown with portions of the IBC cut away and the view enlarged to better illustrate details of the bin liquids intensifier bar.
Figure 18C:
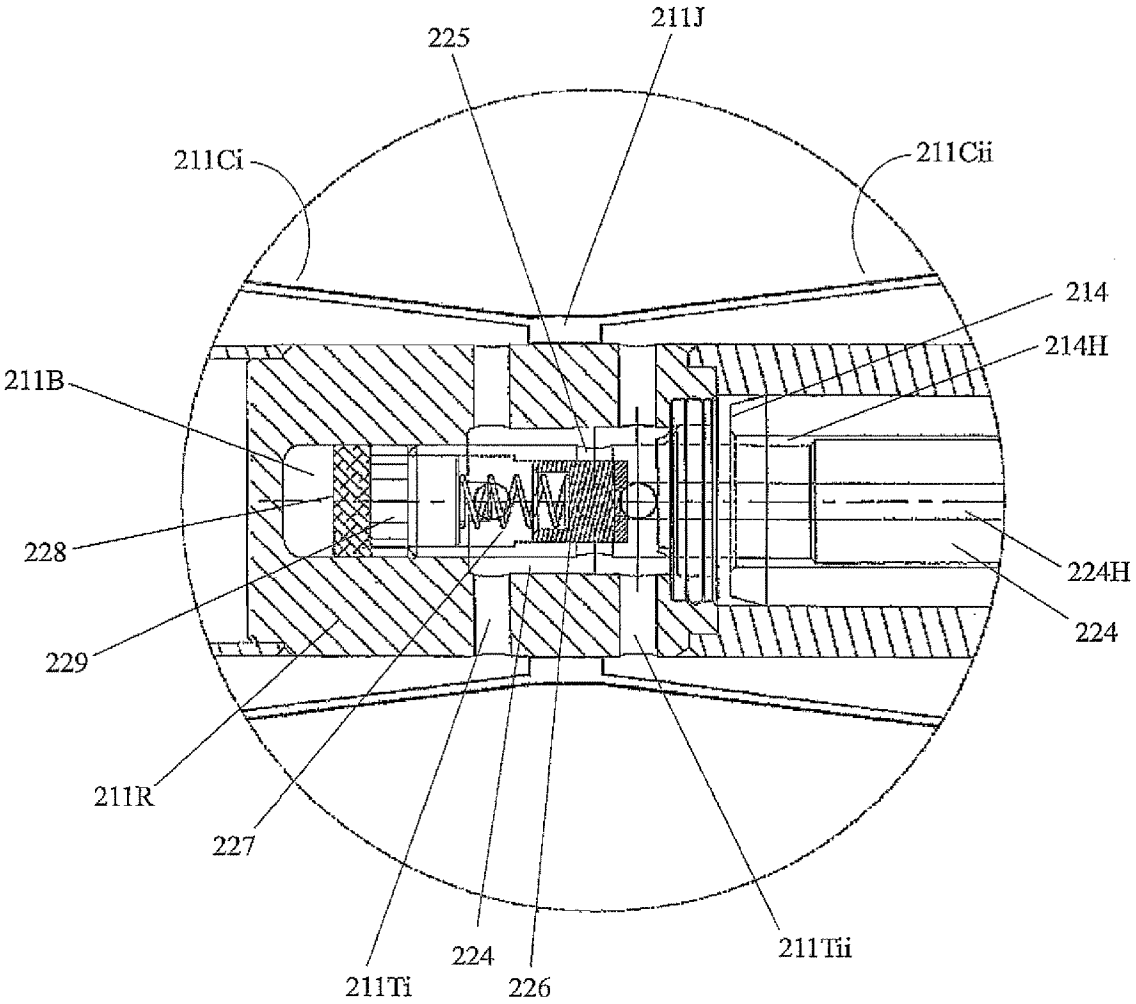
FIG. 18C is an enlarged detail view of the shaft stopper and ports for exiting of the liquid from the shaft into the flow cones.
Figure 18D:
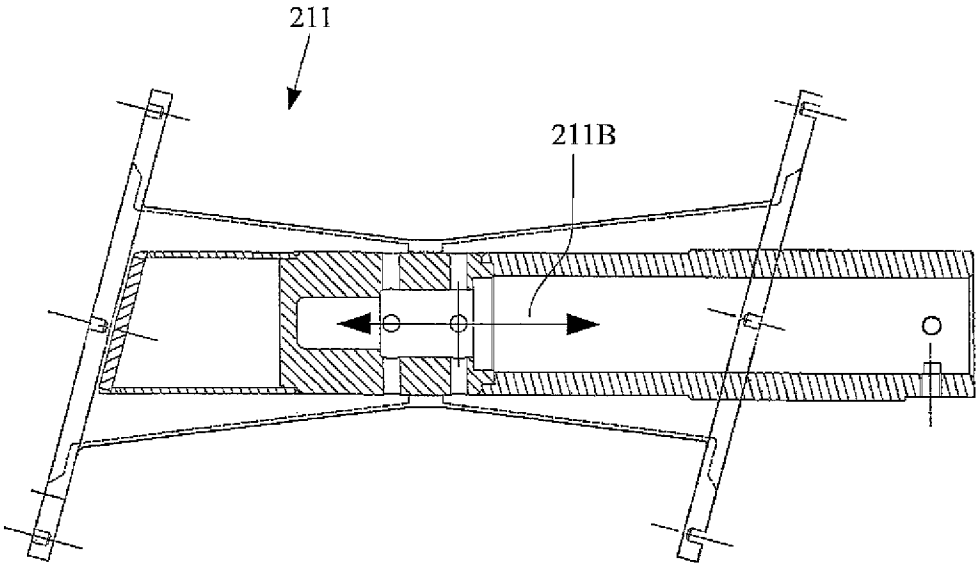
FIG. 18D illustrates the flow cones of the disk support and flow control member.
Figure 18E:
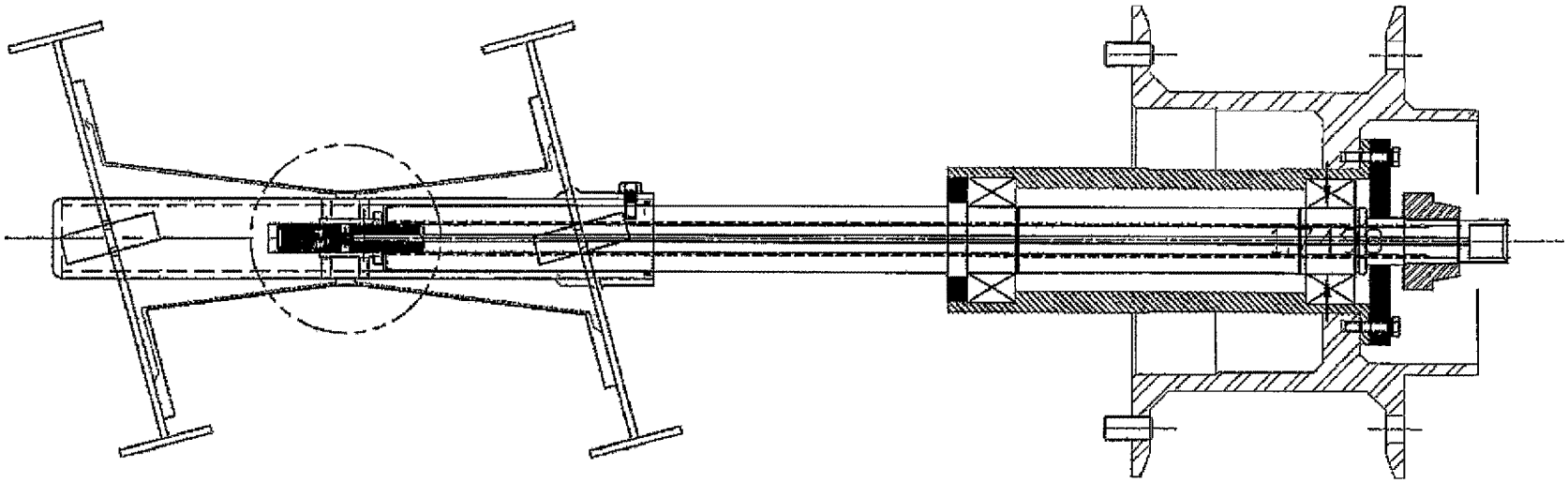
FIG. 18E is the top view of FIG. 18B, but with the seals and the bin completely removed from the view.

Disposed within the opening 214H of drive shaft 214 may be a hollow fluid delivery tube 224 with opening 224H, with one end of the tube protruding out past the drive coupling 222 of the intensifier bar 220, as seen in FIG. 18B, and the other end being disposed beyond the end of the drive shaft 114 to be within the disk support/flow control member 211 to extend into the chamber 211B therein, as seen in FIG. 18C. A transverse through hole 225 may pierce through the fluid delivery tube 224 to permit transverse fluid communication between the opening 224H of the fluid delivery tube 224 and the chamber 211B of the disk support/flow control member 211. The opening 214H at the end of fluid delivery tube 224 may be sealed by an adjustment screw 228 and locking nut 229, which may secure a stopper 226 within the opening 224H of the fluid delivery tube 224. The transverse hole 225 may thereby be selectively sealed by the stopper 226, as the stopper may be biased by a helical spring 227 to normally block the hole. When sufficient fluid pressure is delivered through the fluid coupling 223, which may be rotatably connected to the exposed end of the fluid delivery tube 224, the fluid pressure delivered through the opening 224H of the fluid delivery tube 224 may drive the stopper 226 against the biasing of spring 227 to be clear of the transverse hole 225, so that the fluid may enter the chamber 211B through the transverse hole.

Figure 18F:
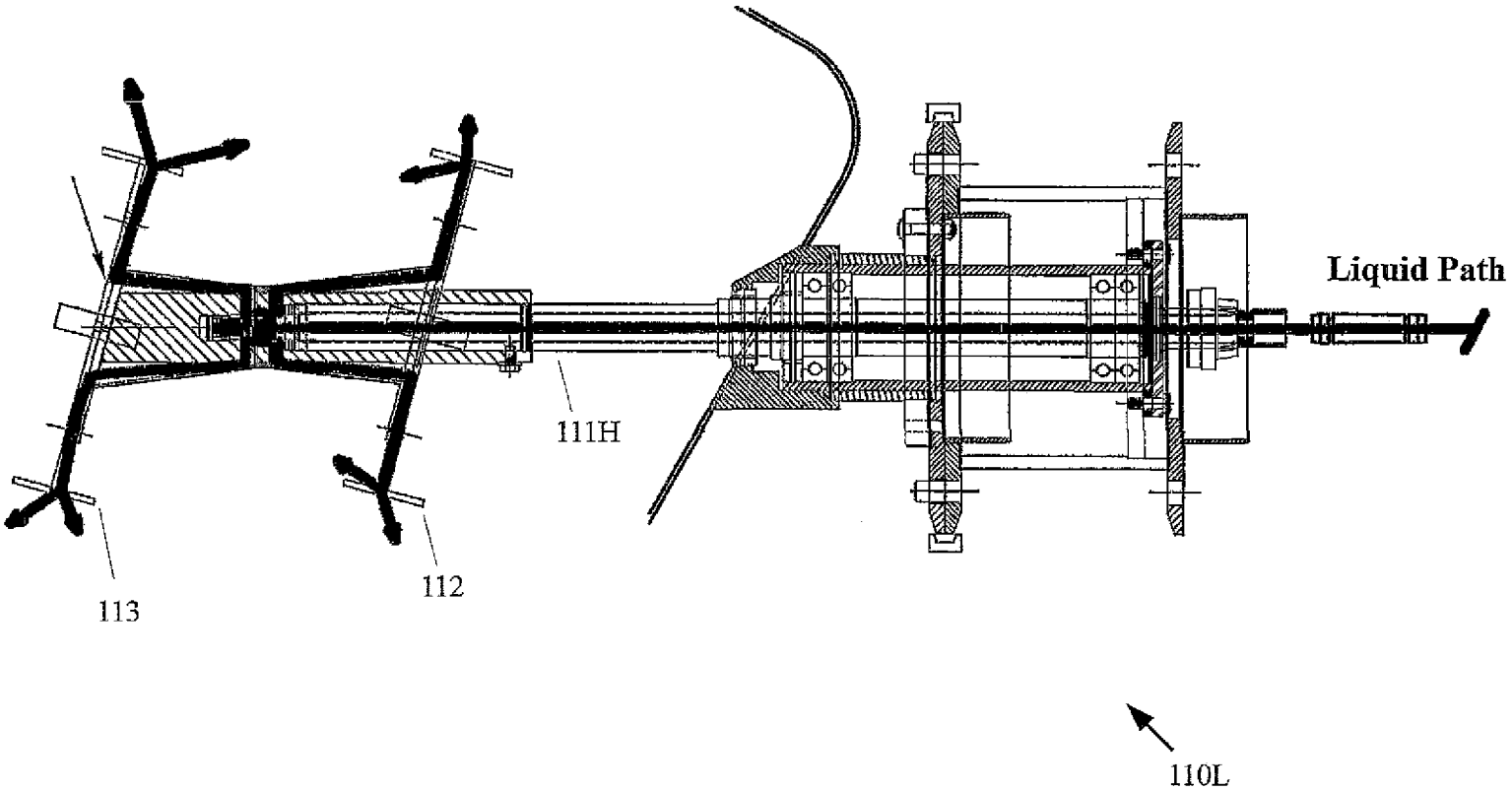
FIG. 18F illustrates the various paths followed by the liquid upon exiting the flow cones, as a result of the action of the I-bar of the bin liquids intensifier bar of FIG. 18A.

The chamber 211B, which may have its open end be sealed against the drive shaft by a seal 216 (FIG. 18B), may also have a pair of transverse holes 211Ti and 211Tii that may be in respective fluid communication with the conduit formed by the first conical surfaces 211Ci, and the conduit formed by the second conical surface 211Cii. So, when fluid pressure forces the stopper 226 backward against the spring biasing of spring 227, the fluid may be delivered through the transverse hole 225, into the chamber 211B, out through transverse holes 211Ti and 211Tii, and through the conduits formed by first and second conical surfaces 211Ci and 211Cii to create the multiple fluid flow patterns of FIG. 18F. These fluid flow patterns may resemble the patterns produced by an oscillating lawn sprinkler because of the canted orientation of the I-shaped tine disks 112 and 113. The outer shape of the mixing bar's disks is designed to help void all liquid. The Liquid may be pumped through the center of the opening 224H of the fluid delivery tube 224 using a peristaltic pump. The shape of the first and second conical surfaces 211Ci and 211Cii assures that after the pump has stopped pumping, that centrifugal forces within the rotating intensifier bar may draw the remaining liquid toward the exit point.

Figures 22A, 22B, 22C:
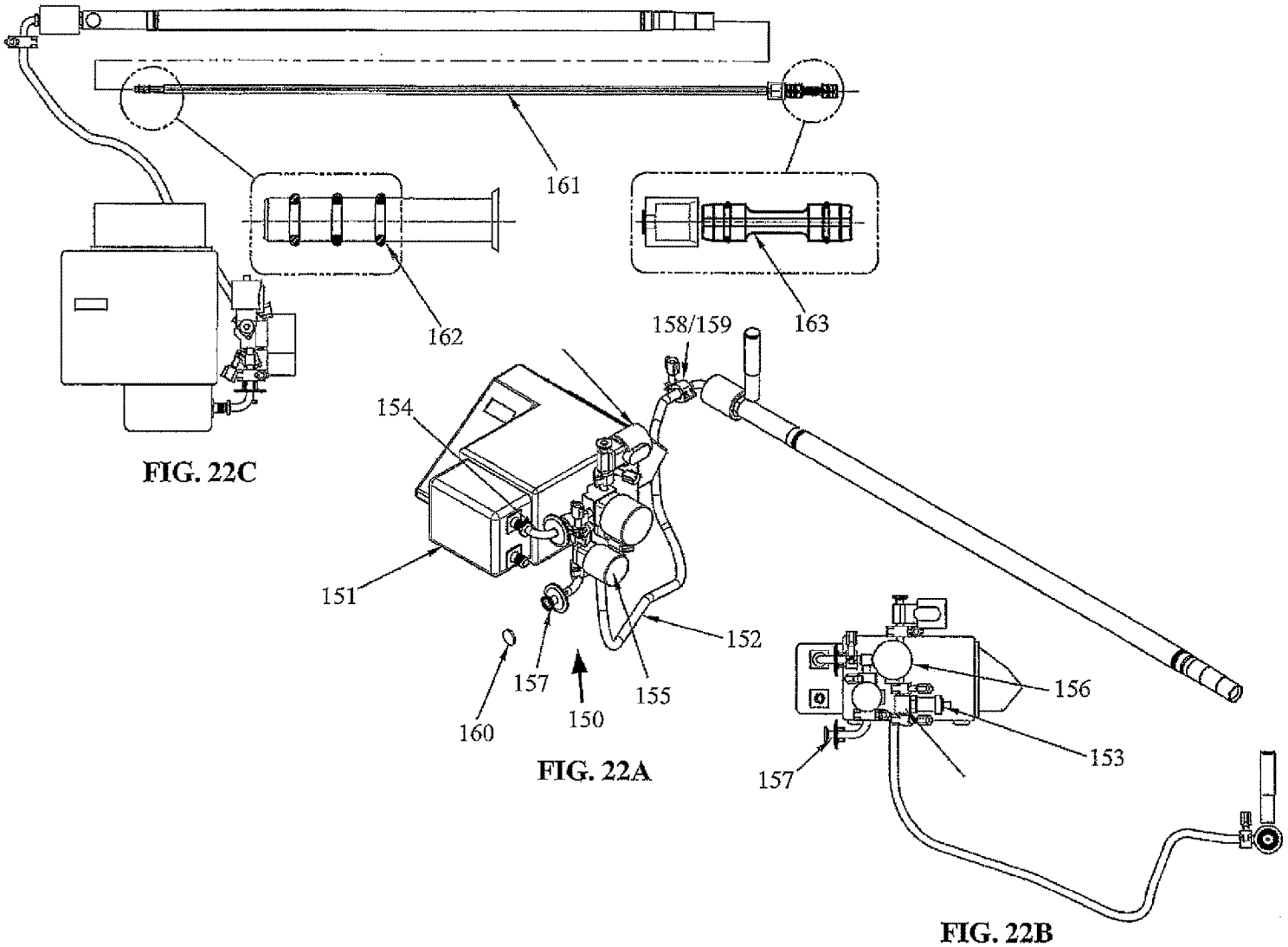
FIG. 22A is a perspective view of the liquid feed assembly of the current invention.
FIG. 22B is a front view of the liquid feed assembly of FIG. 22A.
FIG. 22C is a side view of the liquid feed assembly of FIG. 22A.
Figure 22D:
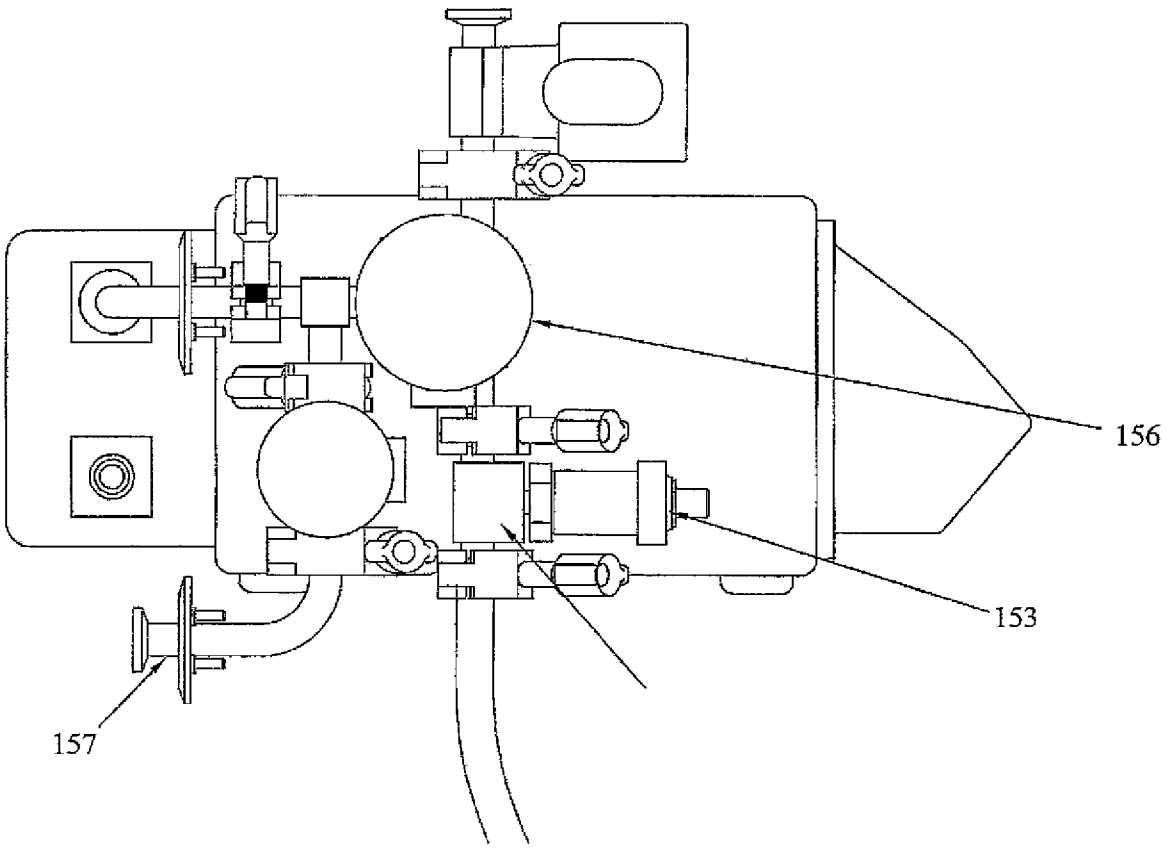
FIG. 22D is an enlarged detail view of the liquid feed assembly of FIG. 22B.

The liquid feed assembly 150 of FIG. 22A may be positioned within the machine portion 20 of blending machine 10 to supply the liquid to the bin liquid intensified 210. The liquid feed assembly 150 may comprise: a peristaltic pump 151, a hose 152, a pressure transducer 153, a liquid feed inlet elbow 154, a first diaphragm valve 155, a second diaphragm valve 156, a liquid feed drain elbow 157, clamp 158, gasket 159, cap 160, an inner liquids shaft 161, and O-rings 162. The fluidic connection between the liquid feed assembly 150 and the bin liquids intensifier bar assembly 110L may be through the rotary liquid feed coupling 163.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. A blending machine, for use in blending substances within an intermediate bulk container in the making of chemicals, food, cosmetics, pharmaceuticals, and the like, said blending machine comprising:

a frame;

a drive motor received in said frame;

a clamp disk rotatably supported by said frame and coupled to said drive motor, to thereby be driven to rotate, said clamp disk comprising means for releasably mating said clamp disk with a corresponding disk of the intermediate bulk container;

a first jaw clamp movably mounted to said frame;

a second jaw clamp movably mounted to said frame; and a clamp drive mechanism configured to drive said first jaw clamp and said second jaw clamp to translate away from each other, or to translate toward each other to releasably secure the corresponding disk of the intermediate bulk container with respect to said rotatable clamp disk.

2. The blending machine according to claim 1, further comprising a second drive motor;

wherein said clamp disk comprises a first portion with said means for releasably mating being selectively coupled to said first drive motor to be driven to rotate at a first rate; and wherein said clamp disk further comprises a second portion configured to receive a shaft of a blending bar of the intermediate bulk container, said second portion of said clamp disk selectively coupled to said second drive motor to be driven to rotate at a second rate, said second rate being different than said first rate.

3. The blending machine according to claim 1 wherein said clamp drive mechanism comprises a first shaft disposed to a first side of said clamp disk, and a second shaft disposed to a second side of said clamp disk to be substantially parallel with said first shaft and wherein a first portion of said first and second shafts each comprises right-handed external screw threading, and a second portion of said first and second shafts each comprises left-handed external screw threading, said first jaw clamp comprising right-handed internal screw threading, to threadably engage said external threading of said first portion of said first and second shafts, and said second jaw clamp comprising left-handed internal screw threading to threadably engage said external threading of said second portion of said first and second shafts, said drive motor configured to drive rotation of said first and second shafts to cause said translation of said first and second jaw clamps.

4. The blending machine according to claim 3 further comprising a first right angle gear box configured to mechanically couple said drive motor to said first shaft, and a second right angle gear box configured to mechanically couple said drive motor to said second shaft.

5. The blending machine according to claim 4 further comprising a clutch and a torque limiter configured to limit an amount of pressure applied by said first jaw clamp and said second jaw clamp, by limiting a torque applied to said first and second shafts.

6. The blending machine according to claim 5 further comprising a limit switch configured to limit said translation of said first jaw clamp and said second jaw clamp.

7. The blending machine according to claim 6 further comprising a post and an actuator, said blending machine configured to be actuated to an elevated position upon said post by said actuator.

8. The blending machine according to claim 7 further comprising nest support structure configured to support said blending machine at said elevated position.

9. The blending machine according to claim 8 wherein said post is rotatable, and wherein a rotary actuator is configured to cause said post rotation.

10. A combination mixing machine and container, for use in homogenizing bulk materials in the making of pharmaceuticals, food, cosmetics, and the like, wherein said container comprises:

a boom extending therefrom, for use in supporting said container, with an end of said boom comprising means for releasably mating said container with said mixing machine; and wherein said mixing machine comprises:

a frame;

a drive motor received in said frame;

a clamp disk rotatably supported by said frame and coupled to said drive motor, to thereby be driven to rotate, said clamp disk comprising means for releasably mating said clamp disk with said mating means on said end of said boom of said container;

a first jaw clamp movably mounted to said frame;

a second jaw clamp movably mounted to said frame; and a clamp drive mechanism configured to drive said first jaw clamp and said second jaw clamp to translate away from each other, or to translate toward each other to rotatably secure said boom of said container to said clamp disk, and wherein said drive motor configured to drive said clamp disk to rotate, is thereby configured to cause rotation of said container to cause mixing.

11. The combination mixing machine and container according to claim 10 further comprising a blending intensifier bar received through an opening in said container into a cavity therein, and being disposed therein, with said boom of said container being configured to releasably receive a portion of said blending intensifier bar therein, and said clamp disk further comprising a concentric coupling configured to receive a shaft of said intensifier, to thereby drive said shaft to rotate and to cause high speed blending in said cavity.

12. The combination mixing machine and container according to claim 11 wherein said motor is configured to drive said concentric coupling at a different rate than said clamp disk.

13. The combination mixing machine and container according to claim 12 wherein said shaft of said blending intensifier bar comprises one or more I-shaped tines.

14. The combination mixing machine and container according to claim 13 further comprising a liquid feed assembly configured to deliver liquid to said cavity of said container through said concentric coupling and through said shaft of said blending intensifier bar, and wherein said shaft of said blending intensifier bar comprises a flow valve to prevent back-flow of said delivered liquid from said container cavity.

15. The combination mixing machine and container according to claim 14 wherein said liquid feed assembly comprises a reservoir, a peristaltic pump, a hose, and one or more diaphragm valves, said peristaltic pump configured to selectively pump a liquid from said reservoir through said shaft of said blending intensifier bar into said container cavity.

16. The combination mixing machine and container according to claim 15 further comprising a cover assembly, said cover assembly comprising:

a cover member;

a hinge, said hinge configured to attach said cover member to said container to be pivotable between a closed position, in which said cover member seals said opening into said cavity of said container, and an open position, in which said opening is unsealed; and a clamp assembly, said clamp assembly configured to releasably secure said cover member in said closed position.

17. The combination mixing machine and container according to claim 16 further comprising a vent arrangement, for use in reducing recesses that undesirably retain the bulk materials therein and alter the exact proportions of the mixed material, said vent arrangement comprising:

an opening in said cover member;

a vent body fixedly secured to said cover member about said opening therein, said vent body being hollow;

a filter configured to be received in said hollow vent body;

a vent plug configured to secure said filter in said vent body; and a cap, said cap configured to retain said vent plug within said hollow vent body.

18. The combination mixing machine and container according to claim 17 wherein said filter comprises a step configured to permit a side of said filter facing inward toward said container cavity to be coterminous with an inward facing side of said cover member.

19. The blending machine according to claim 2 wherein said second rate is faster than said first rate.

* * * * *